US006118415A

United States Patent [19]

Olson

[11] Patent Number: 6,118,415

[45] Date of Patent: Sep. 12, 2000

[54] RESONANT SQUARE WAVE FLUORESCENT TUBE DRIVER

[75] Inventor: Scot L. Olson, Lynnwood, Wash.

[73] Assignee: ELDEC Corporation, Lynnwood, Wash.

[21] Appl. No.: 09/058,732

[22] Filed: Apr. 10, 1998

[51] Int. Cl.[7] ..... G09G 3/10

[52] U.S. Cl. ..... 345/41; 345/47

[58] Field of Search ..... 345/60, 211, 212, 345/37, 41, 47, 74, 75

[56] References Cited

U.S. PATENT DOCUMENTS

| | | |
|---|---|---|
| 2,864,035 | 12/1958 | Davis . |
| 3,508,103 | 4/1970 | Young . |
| 3,890,540 | 6/1975 | Ott . |
| 4,253,046 | 2/1981 | Gerhard et al. . |
| 4,767,965 | 8/1988 | Yamano et al. . |
| 4,851,734 | 7/1989 | Hamai et al. . |
| 4,920,302 | 4/1990 | Konopka . |
| 5,030,894 | 7/1991 | Yoshiike et al. . |
| 5,311,104 | 5/1994 | Antle . |
| 5,319,282 | 6/1994 | Winsor . |
| 5,343,116 | 8/1994 | Winsor . |
| 5,420,481 | 5/1995 | McCanney . |
| 5,440,324 | 8/1995 | Strickling, III et al. . |
| 5,463,274 | 10/1995 | Winsor . |
| 5,466,990 | 11/1995 | Winsor . |
| 5,479,069 | 12/1995 | Winsor . |
| 5,509,841 | 4/1996 | Winsor . |
| 5,536,999 | 7/1996 | Winsor . |

OTHER PUBLICATIONS

R.E. Horstman et al., "The Starting Process in Long Distance Tubes," *J. Phys. D: Appl. Phys.* 21 (1988) 1130–1136.

R.E. Horstman et al., "Gas Breakdown in Long Glass Tubes," Philips Research Laboratories, The Netherlands, pp. 313–315.

J. Millman et al., "Electrical Discharges in Gases," Chap. X of *Electronics,* First Edition, McGraw–Hill Book Company, Inc., New York, 1941, pp. 288–315.

*Primary Examiner*—Matthew Luu

*Attorney, Agent, or Firm*—Christensen O'Connor Johnson Kindness PLLC

[57] ABSTRACT

A driver (10) produces a current to generate traveling waves of voltage for low levels of illumination and an arc voltage for high levels of illumination through a gas discharge lamp (50). At the low illumination levels the traveling waves of voltage are produced in a manner so as to increase the current in the lamp at a controlled rate so that the increase in current can be stopped by an optical or ionization feedback loop when the lamp reaches the glow discharge region, after the Townsend discharge region and before the arc discharge region. Without careful control of the rate of the current increase, the desired current level can easily be overshot or undershot. Also, the feedback is critical given the varying nature of the impedance of gas discharge lamps. The process is repeated at selected intervals to produce a desired average level of illumination. The nature of the traveling waves assists the direction of ion acceleration toward the walls of the lamp, allowing the lamp to be brought to the glow discharge region without damage to the cathode filaments. The cathode filaments are further preserved by the fact that driving the lamp to the glow discharge region for brief time periods rather than to the arc discharge region does not require multiple transitions through the highest voltage regions that precede the arc discharge region. A current feedback loop is used to make the system self-resonating and to increase the frequency of operation when the lamp smoothly transitions to the high illumination arc discharge mode of operation. The method and apparatus of the present invention have been shown to operate cold cathode, hot cathode, serpentine lamp and flat lamp technologies effectively. Dimming ratios have been observed above 20,000:1 for serpentine lamps and above 50,000:1 for flat lamps, with these ratios being effectively doubled when viewed from behind an AM LCD.

47 Claims, 7 Drawing Sheets

Tek Run: 500KS/s
Sample
T
△: 16.67kHz
@: 11.90kHz

Low Luminance
(1 ftL)
322
326
320
324
328
$V_{30a}$
$V_{130}$
$V_{90}$
4
2
CH1 500mV
CH2 500mV
CH4 200V
M 100µs
CH1 −120mV
+1
+2

Tek Stop: 10.0kS/s
65 Acqs
T
△: 37Hz
@: 36Hz

Low Luminance
(1 ftL)
$V_{30a}$
328
320
$V_{130}$
$V_{90}$
CH1 500mV
+1 +2
CH2 500mV
CH4 200V
M 5.00µs
+3
CH1 −120mV
4
2

RESONANT SQUARE WAVE FLUORESCENT TUBE DRIVER

FIELD OF THE INVENTION

This invention relates generally to fluorescent lamps, and more particularly to a method and system for smoothly driving fluorescent lamps at high levels, low levels, and all ranges of illumination between.

BACKGROUND OF THE INVENTION

Fluorescent lamps are used in a variety of environments to efficiently provide different levels of illumination. The conventional fluorescent lamp typically includes a glass tube having an electrode at each end of the tube. The tube is filled with mercury gas and another noble gas, such as argon. The inner surface of the glass tube is coated with phosphor. A drive voltage is supplied across the electrodes, causing the mercury atoms to emit ultraviolet photons. The emitted photons, in turn, excite the phosphorous, creating fluorescent illumination.

To power the conventional fluorescent lamp, the drive voltage is applied across the lamp electrodes, as stated above. The drive voltage is of sufficient magnitude to eject electrons from the electrodes into the tube. The ejected electrons collide with the mercury gas and excite the electrons of the mercury gas to higher energy levels. The collisions break down the mercury gas, causing electrons to flow across the length of the tube. This process of generating a current that flows through the tube is commonly referred to as striking an arc in the tube. While an arc is generated, the drive voltage causes electrons and the mercury atoms to collide with the argon gas. The electrons of the argon gas are first excited to high energy levels. Then the electrons drop down to low energy levels, thereby emitting infrared light.

The conventional fluorescent lamp can be used at various operating levels. The current provided to drive the fluorescent lamp is generally proportional to the illumination output of the fluorescent lamp. To operate the fluorescent lamp at a relatively high level of illumination, the current applied to the fluorescent lamp must be of correspondingly high magnitude. Lower levels of illumination are attained by reducing the magnitude of current provided to drive the fluorescent lamp. In this way, the fluorescent lamp is dimmed by appropriate control of the drive current.

At some threshold point, however, further reduction of the drive current will fail to further dim the fluorescent lamp in the "arc" mode. Rather, when the applied current falls below the threshold point, the arc and the fluorescent illumination it produces can no longer be generated, and a new mode of operation that will be described in more detail below is entered. There are reasons, some of which are discussed below, why it is undesirable to operate a fluorescent lamp in modes other than the arc mode. Accordingly, to dim the fluorescent lamp to low levels of illumination in the arc mode, the conventional fluorescent lamp drive circuit alternatively relies on pulsed applications of drive voltage to generate a discontinuous arc in the lamp. Under this technique, a relatively high drive voltage is briefly applied across the fluorescent lamp, striking a temporary arc in the tube. Then the drive voltage is removed for a predetermined time. Thereafter, a drive voltage is applied again. This technique repeats the application and removal of a relatively high voltage to give the appearance of a dimmed fluorescent lamp.

Many disadvantages stem from the use of conventional fluorescent lamp drivers. Perhaps the most significant disadvantages relate to the application of discontinuous, relatively high voltages to strike an arc. The application of discontinuous, relatively high drive voltages across the fluorescent lamp produces a voltage at the cathode that couples with the ionized gases in the tube. This voltage is commonly referred to as a cathode fall voltage. The cathode fall voltage accelerates the positively charged mercury atoms into the filaments of the cathode. If the cathode fall voltage is excessive, collisions between the mercury atoms with the filaments will cause particles of the filament to detach and accumulate near the ends of the inner surface of the tube in a process known as sputtering. Over time, sputtering can dramatically darken the ends of the tube. Such darkening of the tube significantly compromises the efficiency and durability of the conventional fluorescent lamp.

Another disadvantage of using pulsed applications of voltage to generate a discontinuous arc in the lamp is that the lower end of the illumination range is limited. More specifically, as the driving pulses get further and further apart, the human eye is able to detect a flickering in the lamp. This effect is undesirable for most applications.

The disadvantages of the conventional fluorescent lamp driver are readily apparent in applications requiring both high levels and low levels of illumination. Very often, conventional fluorescent lamps are used as backlighting for liquid crystal displays (LCDs). For example, the conventional fluorescent lamp could be implemented in an aircraft cockpit to illuminate a liquid crystal display. Bright sunshine penetrating the cockpit could make reading the liquid crystal display difficult. Therefore, the conventional fluorescent lamp must be capable of operating at a high level sufficient to adequately illuminate the liquid crystal display in such circumstances. Such high levels of illumination, however, require high drive currents which can mean excessive power levels if the driver is not designed properly.

The operation of the conventional fluorescent lamp at relatively low levels of illumination in connection with liquid crystal displays poses additional drawbacks. These drawbacks are especially problematic in military applications. Liquid crystal displays are used in numerous military environments, including, for example, aircraft instrument panels. The development of night vision technologies has required that conventional fluorescent lamps be operated at very low levels to illuminate a liquid crystal display while avoiding detection by night vision equipment. This requirement, however, is unsatisfied by the design of the conventional fluorescent lamp driver and its stimulation of argon and the subsequent emission of infrared light, which is readily detected by night vision equipment.

An exemplary prior art driver that has been able to obtain relatively high dimming ratios is disclosed in U.S. Pat. No. 5,420,481 to McCanney. The background section of the McCanney patent is particularly instructive, and selected sections are reproduced below. Much of the background section of McCanney, including FIG. 1, appears to have been taken from the textbook *Electronics* by Jacob Millman et al., (1941). FIG. 1 of the McCanney patent has been reproduced as FIG. 1 of the present application. It is notable that the curve shown in FIG. 1 may shift to the left or right along the current axis for different lamp technologies, although the shape of the curve should remain similar to how it is shown. In fact, for more recent lamp technologies the scale of the figure shown in the Millman textbook appears to be more accurate for the given current levels than FIG. 1 of the McCanney patent. In any event, as illustrated in FIG. 1, one of the reasons that fluorescent lamps are so difficult to drive is because the impedance of the lamp changes in a non-linear manner over a range of currents. Thus, the lamp often does not respond to a given input in a predictable manner. The McCanney patent begins its discussion of these complexities with the following description:

All fluorescent tubes are GAS GLOW DISCHARGE DEVICES. A study of the physics of glow or arc discharges in gaseous medium and of gas glowing discharge devices demonstrates that there are many complex and competing processes that produce and remove charges, which alter the ion population and the electric fields that direct them. The control of the current through a conductive, ionized gas is possible, but it is a complex process. The electrical conduction in gases and gas filled tubes encompasses a variety of effects and modes of conduction, ranging from the Townsend discharge at one extreme to the arc discharge at the other. The current ranges from a fraction of 1 microampere in Townsend discharge, to thousands of amperes in the arc discharge. A feature which distinguishes gaseous conduction from conduction in a solid is the active part which the medium plays in the process. Not only does the gas permit the drift of free charges from one electrode to the other, but the gas itself may be ionized to produce other charges which can interact with the electrodes to liberate additional charges. It will be shown below that the current voltage characteristic may be nonlinear and multivalued.

The McCanney patent goes on to discuss various other phenomena that affect the current voltage characteristics of a fluorescent lamp. In exploring the different phenomena that affect the current voltage characteristic of the lamp, McCanney discusses topics such as gaseous conduction, sources of free charge, net free charge concentration, motion of the charges, ion diffusion, and the mechanisms of conduction. For the four general regions A to D shown in FIG. 1, McCanney provides the following descriptions.

REGION A, THE COLLECTION OF CHARGES

The current first rises and then over a limited range is relatively constant as the voltage across the electrodes is increased: The initial rise is the result of the collection of charges which were either recombining or diffusing to the walls. The nearly constant current region is the result of the collection of almost all of the charges.

REGION B, THE TOWNSEND DISCHARGE

In this region, further increase in voltage produces an increase in current. Here, ionization by electronic impact is occurring. The situation is described by specifying that each free electron makes additional ion pairs in traveling 1 cm in the direction of the field. The number n of ion pairs produced per second in 1 cm at a distance x from the cathode (assuming parallel plate electrodes) is given by the relationship, $n=n_0e^x$, where $n_0$ is a constant depending on the initial number of electrons. This is a form of the Townsend equation, and is the first Townsend coefficient.

In the region B, the increase in current represents an increase in . Near the end of this region, the current i increases as a function of applied field. Here, additional effects are taking place, such as the photoelectric process and secondary emission. This is described by the following equation, where β is the second Townsend coefficient, $i_o$ is the initial electron current at the cathode and is the anode current as a function of plate separation x; β is also a function of electric field.

$$i = i_0 \frac{(\alpha - \beta)e^{(\alpha-\beta)x}}{\alpha - \beta e^{(\alpha-\beta)x}} \tag{1}$$

At the end of the region, the slope becomes infinite, and if the external resistance is not too large, the current will jump in a discontinuous fashion. The transition is referred to as a spark, and the potential at which it occurs is the breakdown or sparking potential. The region B is called a Townsend discharge and is not self-sustained. Thus, if the source of primary ionization is removed, the discharge will cease.

REGION C, THE SELF SUSTAINED GLOW DISCHARGE

In this region, as the potential reaches the sparking potential, a transition occurs to the region C. This is the self-sustained glow discharge region. Over an extensive current range, the voltage drop remains substantially constant. During the current increase, a glow occurs at the cathode, and at the upper end of the range the cathode is completely covered. At this point, a further current increase can be achieved only if the potential drop across the discharge is increased. This portion of the characteristic is known as the abnormal glow. Throughout this portion of the discharge characteristic curve, secondary effects are significant. Particularly vital are the effects of cumulative ionization and secondary emission at the cathode.

REGION D, THE ARC DISCHARGE

A further increase in current leads to another mode of discharge, the arc. This is shown in region D in FIG. 1. Characteristic of this mode is the low cathode potential fall and the very high current densities. Thermionic emission is considered the predominant effect in the production of the large number of electrons at the cathode necessary for the arc. This is consistent with the very high temperatures known to exist at the cathode. Although the arc discharge has very great commercial value, its operation is not very well understood.

McCanney also goes on to say the following about the prior art driving techniques.

Currently, pulse width modulation (PWM) techniques are commonly used for controlling the range of dimming of such fluorescent lamps. However, this range is comparatively limited. There is no known PWM controller that has demonstrated a dimming ratio greater than 2000:1 or 66 dB. For example, a fluorescent tube used to backlight liquid crystal displays used in aerospace applications require[s] brightness ratios that extend from levels readable in direct sunlight, at the brightest, to very dim levels readable with night vision goggles. Such brightness ratios require fluorescent tube dimming over a range of foot Lamberts from 0.2 ftL to 10,000 ftL, a ratio of 50,000:1 or 94 dB. This range has never been achieved by high frequency pulse width modulation (PWM) techniques currently in common use. The maximum pulse width that could be applied is limited by the period of the driving waveform on the high end, and by the minimum pulse width possible, based on the rise time of the switching transistors, which is a function of their speed. Practical switching devices do not yet possess the sub-nano second response necessary to achieve the required dimming range.

The McCanney patent goes on to disclose a circuit that is able to overcome some of the disadvantages of pulse width modulation type drivers. The McCanney circuit is described as being able to dim light intensity over a broad range such as from less than 1 ftL to greater than 10,000 ftL (which is a dimming range of greater than 10,000:1). The device uses preionization electrodes located along the outside edges of the lamp along its length. These electrodes are used to produce a transverse electrostatic field over the length of the lamp. In addition, the lamp driver carefully controls the current of the lamp through the use of a current source with a high compliance voltage, which, in combination with the described preionization electrodes, is able to achieve the described dimming ratios.

One theory as to why the McCanney device works can be described with reference to FIG. 1, and in particular the region between the arc discharge and the self-sustained glow discharge. From about the $10^{-1}$ to the $10^{+1}$ current levels (which, as described previously, may be somewhat shifted for different lamp technologies), it can be seen that a very high voltage potential, up to around 1400 volts, exists across the lamp electrodes. One theory as to why it has previously been undesirable to operate a lamp in this range, in addition to the control difficulties described previously, is that the high voltages tend to destroy the lamp. As described previously, high voltages can accelerate the positive ions into the filaments of the cathode. High voltages such as those shown in the region between the arc discharge and self-sustained glow discharge regions are capable of quickly destroying the filaments, and thus designers of prior art drivers have avoided this region of operation. It is notable that the Millman text shows the arc discharge region (where most prior art drivers have operated) as being different from how it is shown in FIG. 1. In FIG. 1, the arc discharge region is shown as starting at the top of the curve at the 10° current level and extending to the left, while in the Millman text the arc discharge region would only begin at about the $10^{+2}$ current level for the curve of FIG. 1.

One theory as to why the McCanney circuit is able to more safely operate in this region is because the transverse electric field that is created by the external lengthwise electrodes accelerates the ions toward the edges of the tube, rather than toward the filaments of the cathode. Thus, the McCanney device is able to operate its lamp over a wider range, despite the higher lamp potential voltages that are encountered that otherwise would act to destroy the filaments of the cathode. However, the McCanney circuit also has certain disadvantages. For example, the external lengthwise electrodes must be formed and positioned externally to the lamp requiring additional circuitry fabrication and spatial considerations. In addition, the circuit is generally described as being used to extend the range of an additional fluorescent lamp driver circuit, thus requiring two circuits and preventing a completely continuous transition from the low illumination levels to the high illumination levels.

Accordingly, there is a need for a new fluorescent lamp driver that overcomes the foregoing and other disadvantages of previously developed fluorescent lamps drivers.

SUMMARY OF THE INVENTION

The present invention is a method and apparatus for driving a fluorescent lamp in a resonant manner with the lamp as an active, integral part of the circuit such that at low levels of illumination the fluorescent lamp is used as a wave guide for two sets of traveling wave-fronts, which are 180° out of phase with each other, and travel from the terminals at the two ends of the lamp, progressing down the tube or channel until they meet at the midpoint between the two terminals. For low levels of illumination, the traveling wave-fronts produce a current in the lamp that is less than the current required to produce an arc discharge in the lamp, thus operating the lamp in the glow discharge region. The velocity at which the wave-fronts move through the channel is proportional to the voltage amplitude driving the waves; the greater the voltage amplitude, the greater the velocity. Mercury is ionized at the wave-fronts as they travel through the gas, and an increasing intensity of fluorescence is built up from the plasma through the lengths of the tube behind the traveling wave-fronts; thus, in a sense, filling the tube from the ends to the center with a light generating plasma. The process is terminated when the wave-fronts meet at the center of the tube and the system is relaxed until the light level in the tube falls below a predetermined threshold, at which point the process is repeated. Thus, when higher voltage amplitudes are used to drive the waves, fewer waves are produced before the waves reach the center of the tube and cause the system to be relaxed. Extremely low levels of illumination can be achieved with this method.

At the low illumination levels the traveling waves of voltage are produced in a manner so as to increase the current in the lamp at a carefully controlled rate so that the increase in current can be stopped by an optical or ionization feedback loop when the lamp reaches the glow discharge region of the voltage-current characteristic curve of the lamp, after the Townsend discharge region and before the arc discharge region. Without careful control of the rate of the current increase, the desired current level can easily be overshot or undershot. Also, the optical or ionization feedback is critical given the varying nature of the impedance of gas discharge lamps. The process is repeated at selected intervals to produce a desired average level of illumination.

The nature of the traveling waves assists the direction of ion acceleration toward the walls of the lamp, allowing the lamp to be brought to the glow discharge region without damage to the cathode filaments. The cathode filaments are further preserved by the fact that driving the lamp to the glow discharge region for brief time periods rather than to the arc discharge region for brief time periods (as was done to dim lamps in the prior art pulse width modulation methods) does not require multiple transitions through the highest voltage regions that precede the arc discharge region. In other words, since an arc is not struck in the lamp at the low illumination levels, the filaments are not subjected to debilitating cathode-fall voltages, thereby extending the life in the lamp. Also, the noble gases used in the lamp, such as argon, will not become ionized and, as a consequence, the infrared emissions from the plasma will be diminutive. This makes the system compatible in military equipment where night vision goggle use is required.

A further advantage of the invention is that through the use of a current feedback loop the same configuration will also drive the fluorescent lamp to progressively higher levels of illumination, in a smoothly continuous manner, until the lamp is being driven in a resonant square-wave fashion with a continuous arc of current. Using a continuous arc of current at the higher illumination levels, similar to the driving of the lamp in the glow discharge region at lower illumination levels, does not require multiple transitions through the highest voltage regions that precede the arc discharge region. Controlling the arc plasma in this way is conterminous with a low cathode-fall voltage at the filaments, indicative of longer filament life and a higher efficacy. The entire luminance range is thus achieved by one simple, elegant circuit design capable of dimming ratios in excess of 20000:1 in tube lamps and in excess of 50000:1 in flat lamps. In addition, the perceived dimming ratios may even be further doubled (40000:1 for tube lamps and 100000:1 for flat lamps) when the lamps are viewed from behind an AM LCD. When the lamps are placed behind an AM LCD, bursts of light that would otherwise be perceivable to a viewer at the lowest dimming levels become imperceptible for up to twice the range. The circuit is also capable of driving both hot and cold cathode lamps. Also, this circuit and method are able to smoothly drive flat lamps, which is an improvement over many prior art drivers, which have been unable to effectively drive flat lamps.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
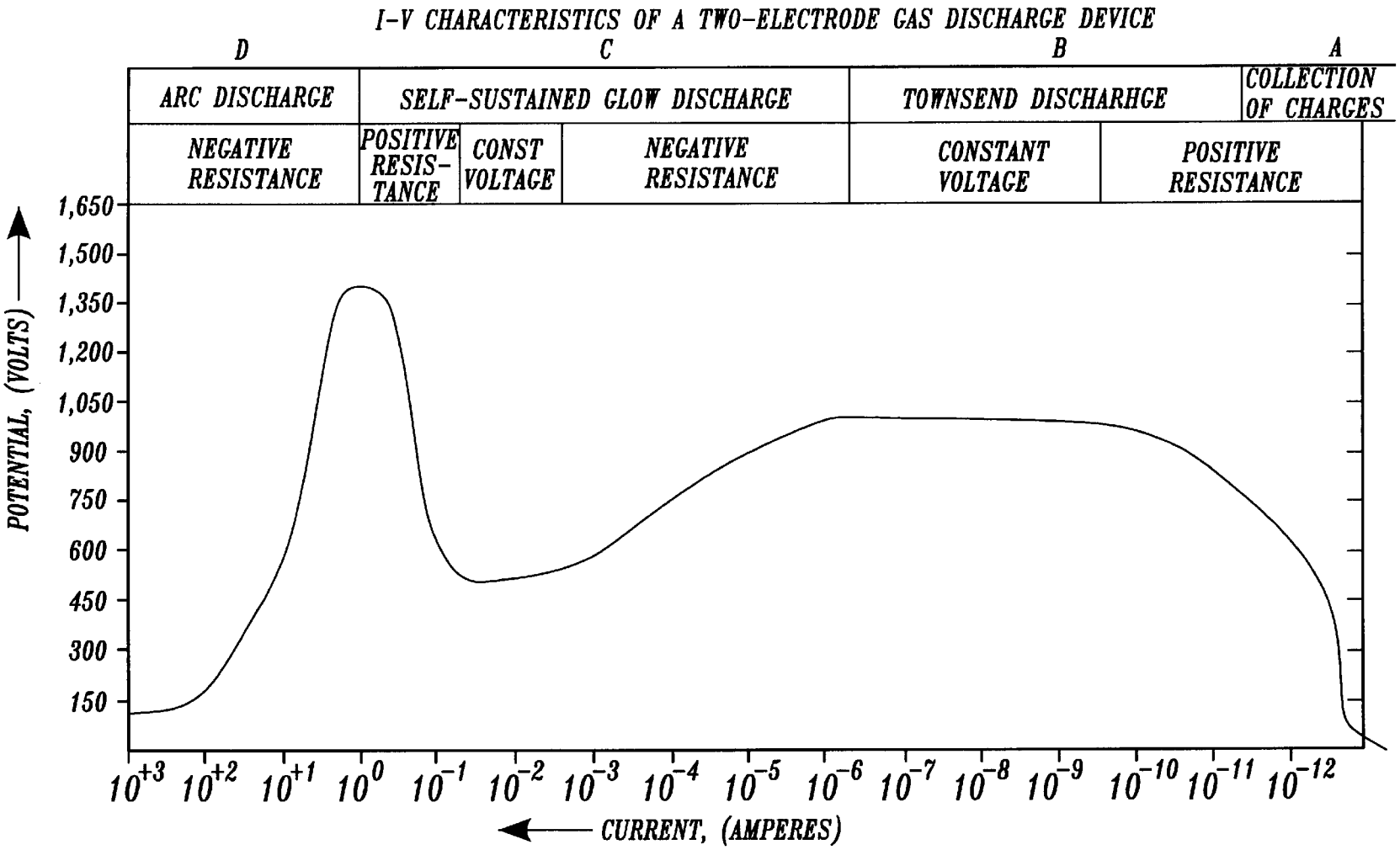
Fig. 1. (prior art)
FIG. 1 is a prior art diagram of a plot illustrating the current potential characteristics of a two-electrode gas discharge device with constant pressure.

In general, the circuit of the present invention is able to safely operate in the non-arc discharge region of FIG. 1 (a.k.a. the "glow discharge" region) to produce low levels of illumination without destroying the lamp. As described previously with reference to the McCanney patent, operation in this region allows extension of the lower end of the dimming range that has previously been unattainable by the arc discharge pulse-width modulation circuits of the prior art. Unlike the McCanney device, the circuit of the present invention does not use external electrodes along the length of the lamp to accomplish operation in the glow discharge region, and instead uses a "traveling wave" concept that will be described in more detail below near the end of this specification.

It is thought that the traveling wave concept prevents destruction of the filaments of the lamp by causing ions to be directed to the edges of the tube, rather than toward the cathode filaments, similar to the intent of the external electrodes of the McCanney circuit. However, the present circuit does not require the use of external electrodes. In addition, the traveling wave method actually extends the life of the lamp by reducing the wear on the cathode filaments, when compared to the pulse width modulation methods of the prior art that used discontinuous arcs to dim the lamp. Also, the present circuit uses the impedance of the lamp itself as a component in an oscillation feedback loop, which as will be described below allows the circuit to smoothly transition between the arc mode and non-arc mode regions of operation. This smooth transition also reduces wear on the cathode filaments and in addition provides the obvious advantage of a continuous method of operation between high and low levels of illumination. In addition, a sensor feedback loop from the illumination of the lamp itself controls the driving circuit oscillations to ensure that the proper circuit operation is maintained. The method and circuitry of the present invention are able to achieve dimming ratios that have previously been unobtainable with conventional circuitry, including in some tests ratios exceeding 20000:1 for serpentine lamps and 50000:1 for flat lamps. These ratios correspond to the dimming of the lamps to less than 0.5 ftL spot brightness. These ratios have even been doubled when viewed from behind an AM LCD, which appears to effectively cancel some of the perceivable pulsing effect at the lowest illumination levels. The flat lamps referred to are the type which now comprise about 10% of the gas discharge lamp market and which are produced in the form of a sealed box with various internal dividers forming a long single internal channel with multiple bends. These flat lamps have previously been difficult to drive with the methods of prior art drivers, although they work very well with the present invention.

Figure 2:
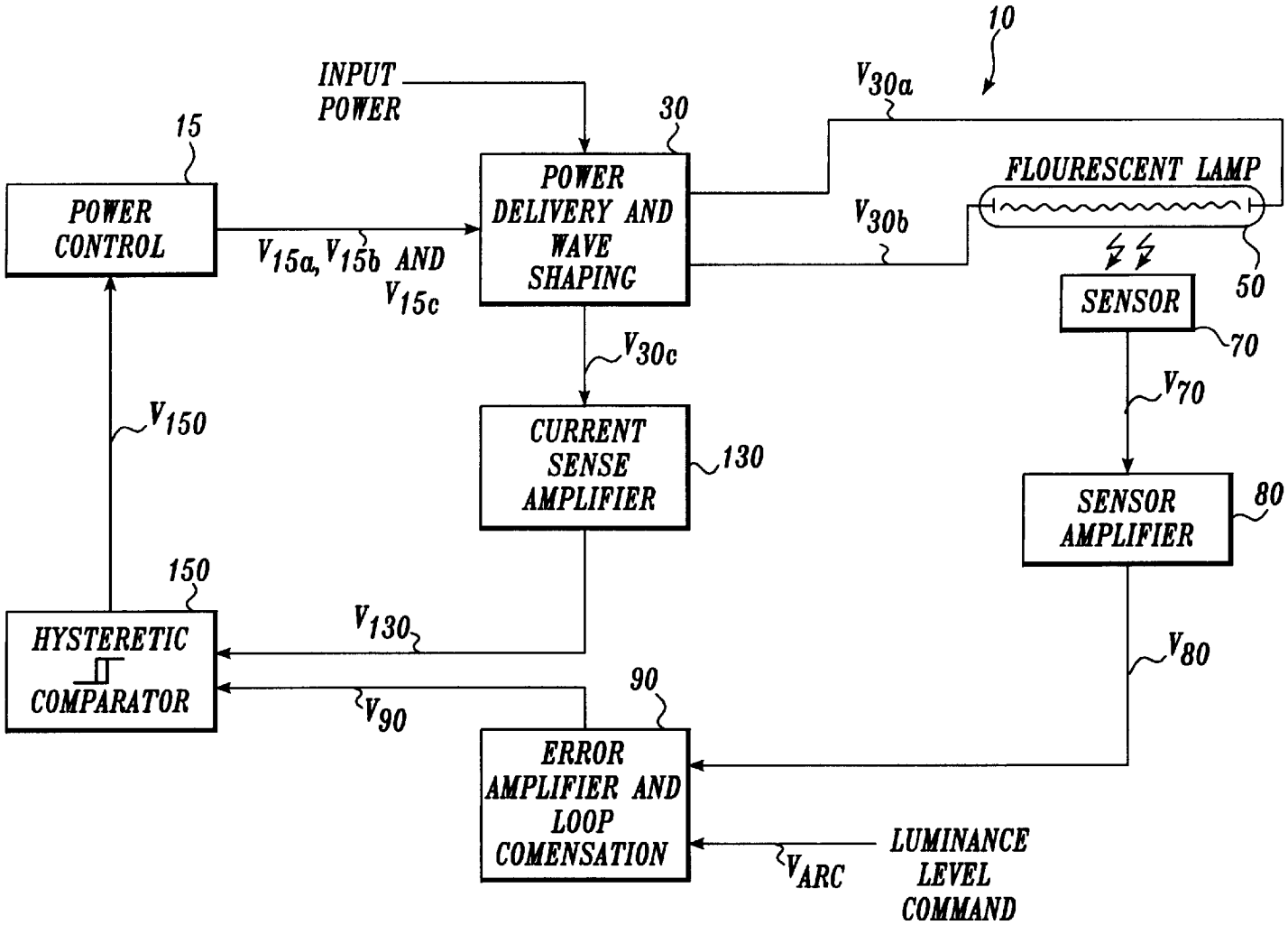
FIG. 2 is a block diagram of an embodiment of a driver for a fluorescent lamp in accordance with the present invention.

The overall structure and operation of the driver 10 is first discussed generally below with reference to FIG. 2, and then a more detailed discussion is provided with respect to FIG. 3. As shown in FIG. 2, the system of the present invention includes a resonant square wave fluorescent tube driver 10 and a fluorescent lamp 50. The driver 10 is a power oscillator, driving the fluorescent lamp 50 to various levels of illumination. The driver 10 drives the fluorescent lamp 50 with a continuous resonant square wave of arc current and arc voltage to attain high levels of illumination from the fluorescent lamp 50. To attain low levels of illumination, the driver drives the fluorescent lamp with resonant square traveling waves of current and voltage. The use of the driver 10 to drive the fluorescent lamp 50 enhances the efficiency, performance, and durability of the fluorescent lamp 50.

Referring to FIG. 2, the present invention uses control signals $V_{15a}$, $V_{15b}$, and $V_{15c}$ from power control circuitry 15 to control power delivery and wave-shaping circuitry 30 which drives the fluorescent lamp 50. Power delivery and wave-shaping circuitry 30 generates voltage waveform signals $V_{30a}$ and $V_{30b}$ across the electrodes of the fluorescent lamp 50. The fluorescent lamp 50 produces varying levels of illumination depending on the voltage waveforms supplied by power delivery and wave-shaping circuitry 30. The illumination (or other parameter) of the fluorescent lamp 50 is sensed by sensor 70 which produces a variable signal $V_{70}$ that is dependent on the output of the fluorescent lamp 50. Sensor amplifier circuitry 80 amplifies the output signal $V_{70}$ from the sensor 70 and provides the amplified signal $V_{80}$ to error amplifier and loop compensation circuitry 90. Error amplifier and loop compensation circuitry 90 also receives a luminance level command signal $V_{ARC}$, and amplifies the differential between the luminance level command signal $V_{ARC}$ and the amplified sensor signal $V_{80}$ from sensor amplifier circuitry 80. The output signal $V_{90}$ of the error amplifier and loop compensation circuitry 90 is provided to hysteretic comparator 150 as a first comparator input. A second comparator input is the signal $V_{130}$ that is provided to the hysteretic comparator 150 by a current sense amplifier 130 which senses and amplifies a voltage that is representative of the level of current being generated by the power delivery and wave-shaping circuitry 30. The hysteretic comparator 150 compares the first comparator input $V_{90}$ from error amplifier and loop compensation circuitry 90 to the second comparator input $V_{130}$ from the current sense amplifier 130. When the hysteretic comparator 150 determines that the signal $V_{90}$ from the error amplifier and loop compensation circuitry 90 is less than the signal $V_{130}$ from the current sense amplifier 130, then the hysteretic comparator 150 outputs a high logic signal (e.g., 5 V); otherwise, the hysteretic comparator 150 outputs a low logic signal (e.g., 0 V). The output of the hysteretic comparator 150 controls the power control circuitry 15. Thus, the driver 10 uses feedback loops to precisely control the fluorescent lamp 50.

The driver 10 of FIG. 2 generally operates in the following manner. This description corresponds to some of the waveforms in FIGS. 5 to 7, which will be described in greater detail following the detailed circuitry description below. When the fluorescent lamp 50 is originally off, the sensor 70 and sensor amplifier circuitry 80 output a low signal level $V_{80}$ that is less than the luminance level command voltage $V_{ARC}$ received by error amplifier and loop compensation circuitry 90. For as long as the sensor amplifier circuitry 80 output signal $V_{80}$ is lower than the luminance level command voltage $V_{ARC}$ (thus indicating that the brightness of the lamp has not yet reached the desired level of illumination), the output signal $V_{90}$ of the error amplifier and loop compensation circuitry 90 will be above a threshold value. For as long as the output signal $V_{90}$ of the error amplifier and loop compensation circuitry 90 is above the threshold value, the output signal $V_{130}$ of the current sense amplifier 130 will oscillate between points above and below the output signal $V_{90}$ of the error amplifier and loop compensation circuitry 90, thus causing the output signal $V_{150}$ of the hysteretic comparator 150 to oscillate between high and low states, thus driving the power control circuitry 15, power delivery and wave-shaping circuitry 30, and fluorescent lamp 50 (e.g., see oscillating portion of signal $V_{130}$ in FIG. 5B). As will be described in more detail below, for as long as the output signal $V_{130}$ of the current sense amplifier circuitry 130 continues to oscillate between points above and below the output signal $V_{90}$ of the error amplifier and loop compensation circuitry 90, the output signal $V_{150}$ of hysteretic comparator 150 will continue to switch between high and low states, thus continuing to cause driving voltage waveforms $V_{30a}$ and $V_{30b}$ to be provided to the fluorescent lamp 50 (see FIG. 5A). As will be described in more detail below, the oscillations of waveforms $V_{30a}$ and $V_{30b}$ are what produce the traveling waves of the lamp.

Figures 5A, 5B:
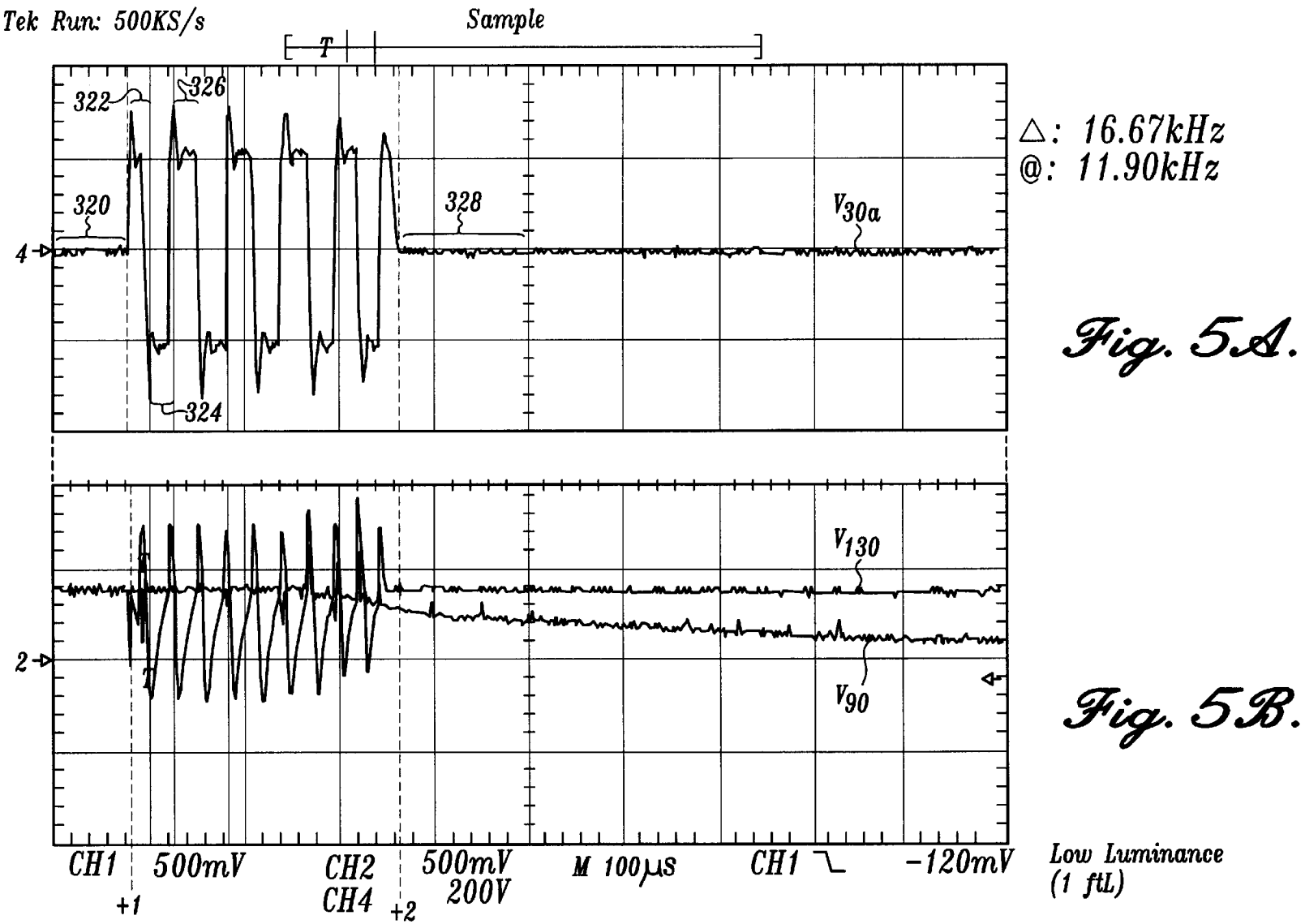
FIGS. 5A–5B are graphs illustrating the operation of the driver during a short time period during low levels of illumination.
Figures 6A, 6B:
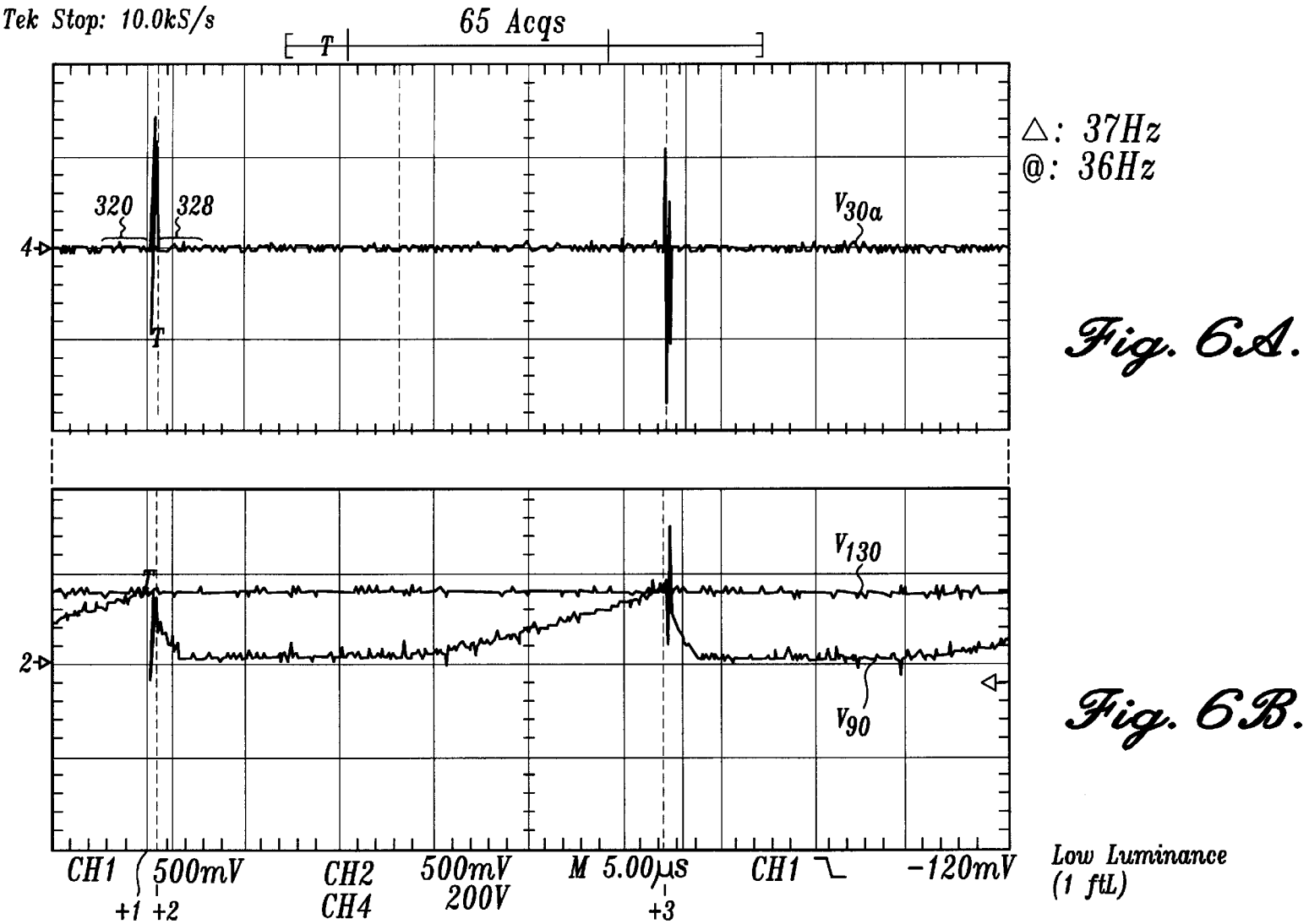
FIGS. 6A–6B are graphs illustrating the operation of the driver during a long time period during low levels of illumination.

Once the illumination of the fluorescent lamp 50 has reached a sufficient level, the sensor 70 and sensor amplifier circuitry 80 will output a voltage signal $V_{80}$ that is greater than the luminance level command voltage $V_{ARC}$ received by the error amplifier and loop compensation circuitry 90. Once this occurs, the output signal $V_{90}$ of the error amplifier and loop compensation circuitry 90 trends below the threshold value, which the output signal $V_{130}$ of current sense amplifier 130 is no longer able to oscillate below. (See signal $V_{90}$ to the right on short-term graph FIG. 5B, and at the lower areas of long-term graph FIG. 6B.) Once the signal $V_{130}$ stops oscillating below the signal $V_{90}$, the output signal $V_{150}$ of the hysteretic comparator 150 no longer switches between high and low states, and instead remains at a high state. The continuous high state of output signal $V_{150}$ causes the fluorescent lamp 50 to no longer be driven by voltage waveforms $V_{30a}$ and $V_{30b}$, until the illumination of the fluorescent lamp 50 again falls below a threshold level (as determined by signal $V_{ARC}$) (e.g., see the flat portions of signal $V_{30a}$ in FIGS. 5A and 6A). Once the illumination of the fluorescent lamp 50 falls below the threshold level, the sensor 70 and sensor amplifier circuitry 80 output the signal $V_{80}$ at a level that is again below the luminance level command voltage $V_{ARC}$, thus causing the driver 10 to again activate and begin driving the fluorescent lamp 50. (This corresponds to the high points of signal $V_{90}$ in FIG. 6B, where it can be seen that signal $V_{30a}$ of FIG. 6A is activated.) As will be described in more detail below, during low luminance operation, the signal $V_{80}$ will continue to fall below luminance level command voltage $V_{ARC}$ at periodic intervals, while during high luminance operation, the signal $V_{80}$ will be forced by the closed loop action of the drive circuit to remain at the luminance level command voltage $V_{ARC}$. These modes of operation will be described in more detail below with reference to FIGS. 5 to 7.

Figure 3:
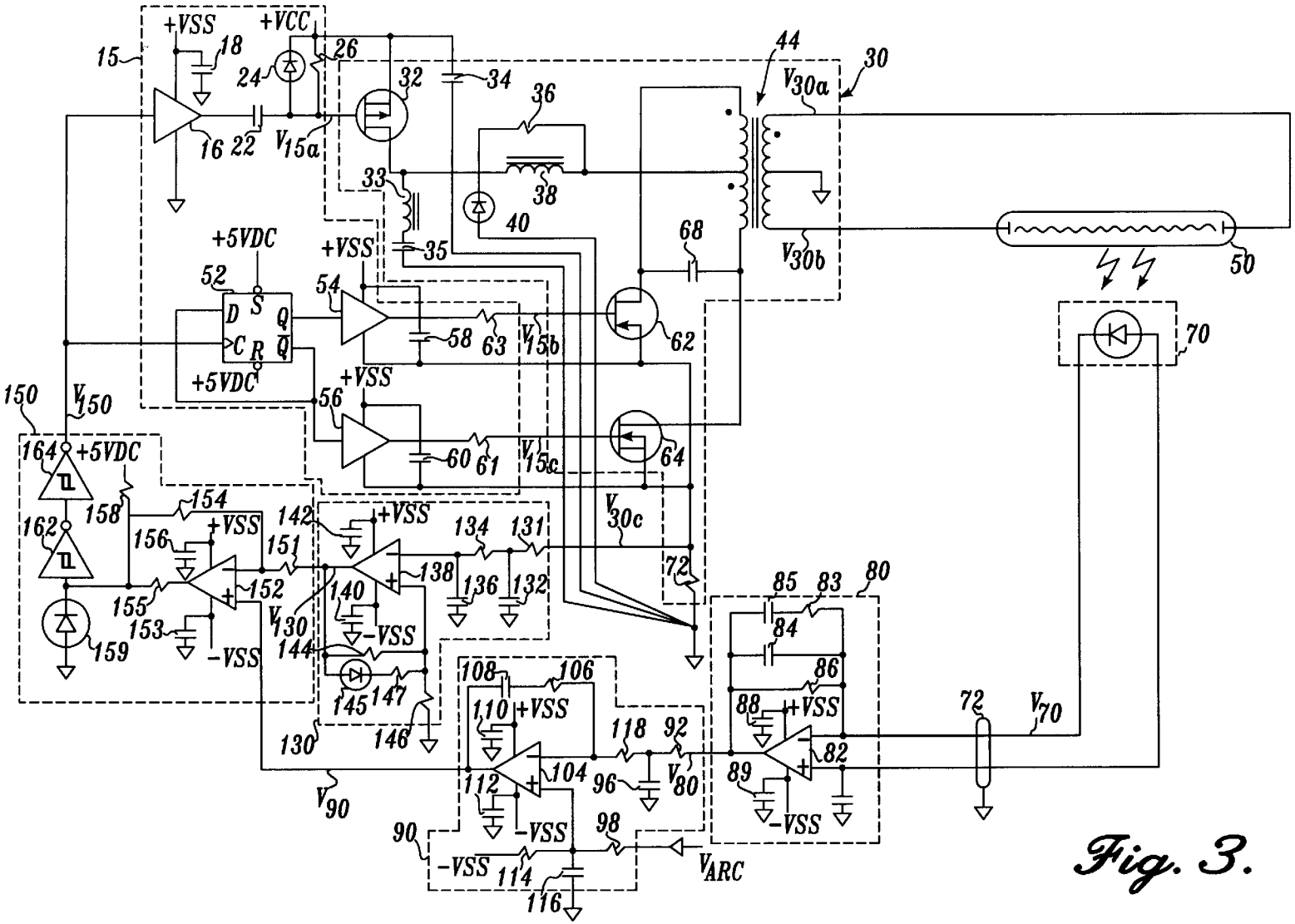
FIG. 3 is a schematic diagram of an actual implementation of the driver of FIG. 1.

An actual embodiment of the driver 10 is illustrated in FIG. 3. The circuit diagram of FIG. 3 illustrates one way in which the general components of FIG. 2 may be implemented. Each of the general components of FIG. 3 will now be discussed in detail.

As described above, power control circuitry 15 is activated by signal $V_{150}$ from hysteretic comparator 150 to control power delivery and wave-shaping circuitry 30. Power control circuitry 15 outputs three control signals $V_{15a}$, $V_{15b}$ and $V_{15c}$ that control three switches within power delivery and wave-shaping circuitry 30. Control signal $V_{15a}$ controls a p-channel FET switch 32 in power delivery and wave-shaping circuitry 30, as will be described in more detail below.

Control signal $V_{15a}$ is primarily generated by a FET drive amplifier 16 within power control circuitry 15. Power supply connections of the FET drive amplifier 16 are connected to power supply voltages $V_{ss}$ and ground. In the preferred embodiment, the power supply voltage $V_{ss}$ is between 12 V and 18 V. A capacitor 18 is connected between the power supply voltage $V_{ss}$ and ground for filtering purposes, as is well known in the art. The output of the FET drive amplifier 16 is capacitively coupled by a capacitor 22 to the gate of p-channel FET switch 32 and to the corresponding control signal $V_{15a}$. The capacitor 22 acts as a high pass filter from the output of amplifier 16 for producing the control signal $V_{15a}$. The gate of switch 32 is also coupled to the anode of a diode 24 and to one side of a resistor 26 that are also located within power control circuitry 15. The cathode of the diode 24 and the other side of the resister 26 are coupled to an input voltage $V_{cc}$. In the preferred embodiment, the input voltage $V_{cc}$ is typically 28 V DC when the driver 10 is implemented in an aircraft environment. However, other values of the input voltage $V_{cc}$ are possible. When the input voltage $V_{cc}$ is larger than the internal auxiliary power supply voltage $V_{ss}$, the capacitor 22, diode 24, and resistor 26 allow the power control circuitry 15 to produce control signal $V_{15a}$ that controls the p-channel FET 32 in power delivery and wave-shaping circuitry 30.

Power control circuitry 15 also produces control signals $V_{15b}$ and $V_{15c}$ to control n-channel FET switches 62 and 64 in power delivery and wave-shaping circuitry 30. Power control circuitry 15 controls the operation of the n-channel FETs 62 and 64 so that they alternately turn on and off 180° out of phase with each other, to cause a transformer 44 to produce an AC signal that drives the fluorescent lamp 50. Control signals $V_{15b}$ and $V_{15c}$ are primarily transitioned by a flip-flop 52 within power control circuitry 15. The outputs Q and not Q of the flip-flop 52 produce the control signals $V_{15b}$ and $V_{15c}$, respectively, so that one control signal $V_{15b}$ or $V_{15c}$ is high while the other one is low, in alternating fashion. A positive going edge applied to an input C of the flip-flop 52 causes the values of outputs Q and not Q to flip. The input C is coupled to the output voltage signal $V_{150}$ from comparator 150, so that a positive transition on signal $V_{150}$ (when the output signal $V_{150}$ of the comparator transitions from a low to a high) causes one of the voltage signals $V_{15b}$ and $V_{15c}$ to transition from low to high, and the other to transition from high to low.

In order to cause the flip-flop 52 to transition properly, a set terminal S and a reset terminal R are connected to a supply voltage (5 V DC), and the output not Q is connected to an input D. The outputs Q and not Q from flip-flop 52 become the control signals $V_{15b}$ and $V_{15c}$ after being amplified by amplifiers 54 and 56, respectively, and transmitting through resistors 63 and 61, respectively. The positive rails of the amplifiers 54 and 56 are connected to a power supply voltage $V_{ss}$. The positive rail of the amplifier 54 is coupled to its negative rail by a capacitor 58, and the positive rail of the amplifier 56 is coupled to its negative rail by a capacitor 60. The negative rails of the amplifiers 54 and 56 are coupled together and are also coupled to the sources of n-channel FETs 62 and 64, which as described below are coupled through a sense resistor 72 to ground.

As described above, control signals $V_{15a}$, $V_{15b}$, and $V_{15c}$ control p-channel FET 32, n-channel FET 62, and n-channel FET 64, in power delivery and wave-shaping circuitry 30. As will be described in more detail below, p-channel FET 32 controls the power to the primary winding of a transformer 44, while n-channel FETs 62 and 64 control the direction of current through the primary winding of the transformer 44.

The source of the p-channel FET 32 is connected to the input voltage $V_{cc}$. A capacitor 34 is connected between the input voltage $V_{cc}$ and ground for filtering purposes, as is well known in the art. The anode of a diode 40 is connected to ground, and the cathode of the diode 40 is connected to the drain of the p-channel FET 32. The drain of the p-channel FET 32 is also connected to one terminal of an inductor 38. The other terminal of the inductor 38 is connected to a center tap of the transformer 44. A resistor 36 is connected in parallel with the inductor 38. An inductor 33 and a capacitor 35 are connected in series between the drain of the p-channel FET 32 and ground. The size of the inductor 38 and the transformer 44, as well as the rate at which the fluorescent lamp 50 absorbs energy, determines the frequency at which the driver 10 operates. The use of the impedance of lamp 50 itself as one of the components for determining the frequency at which the driver 10 operates is a key concept for achieving the precise control and smooth transitioning of the driver 10 between its high and low illumination levels, as will be described in more detail below.

The transformer 44 of power delivery and wave-shaping circuitry 30 applies current generated on its secondary winding to the fluorescent lamp 50. The transformer 44 includes a center-tapped primary winding and a secondary winding that produces voltages $V_{30a}$ and $V_{30b}$ at its terminals that are applied to the electrodes of the fluorescent lamp 50. A first terminal of the primary winding of the transformer 44 is connected to the drain of the n-channel FET 62. A second terminal of the primary winding of the transformer 44 is connected to the drain of the n-channel FET 64. A capacitor 68 is connected between the drain of the n-channel FET 62 and the drain of the n-channel FET 64. The center tap of the primary winding of the transformer 44 is connected to the inductor 38. The first terminal of the secondary winding of the transformer 44 produces voltage signal $V_{30a}$ that is applied to one electrode of the fluorescent lamp 50, while the second terminal of the secondary winding of the transformer 44 produces voltage signal $V_{30b}$ that is applied to the other electrode of the fluorescent lamp 50. A center tap of the secondary winding is connected to ground. The sources of the n-channel FETs 62 and 64 are connected together and to ground through a sense resistor 72. As will be described in more detail below, the sense resistor 72 develops a voltage indicative of the amount of current flowing through the transformer 44.

As described above, the fluorescent lamp 50 produces varying levels of illumination dependent on the waveform signals $V_{30a}$ and $V_{30b}$ from the secondary winding of the transformer 44. The level of illumination produced by the fluorescent lamp 50 is sensed by a sensor 70 which may be an optical sensor such as a photodiode. The photodiode 70, optical amplifier circuit 80, error amplifier and loop compensation circuitry 90, and comparator circuit 150 all form part of an optical feedback closed control loop. Over time, a given commanded level of drive current, as determined by a user of the driver 10 through luminance level command $V_{ARC}$, will not yield the same level of illumination. For example, phosphor aging and temperature effects undesirably contribute to changing output levels of fluorescent lamps. In addition, the V-I characters of FIG. 1 and the previously described multiple phenomenon that can affect the luminance output illustrate the temperamental nature of fluorescent lamps. Optical feedback in accordance with the present invention allows the driver 10 to compensate for such varying lamp parameters and performance, ensuring that a given commanded drive voltage and drive current will produce a given level of illumination. Optical feedback also allows the fluorescent lamp to be driven with traveling waves at low levels of illumination, as will be described in more detail below.

The photodiode 70 is positioned adjacent to the fluorescent lamp 50 at the midpoint between the two lamp electrodes to detect the level of illumination provided. For a serpentine lamp, this positioning may be near the center bend of the lamp. The photodiode 70 is positioned near the midpoint between the two lamp electrodes because electric field effects originate from the lamp electrodes, which could potentially interfere with the sensing operation of the photodiode 70. The electric field effects cancel one another where they meet at the center of the lamp, thus allowing the photodiode 70 to accurately measure the illumination at that position. Also, the photodiode 70 at the center position is able to accurately measure the traveling wave effect, as will be described in more detail below. The anode of sensor 70 is coupled to ground, while the cathode of sensor 70 produces a signal $V_{70}$ that is amplified by the sensor amplifier circuitry 80. The two lines from the anode and cathode of the sensor 70 are surrounded by a shielding 72, which is grounded.

The sensor amplifier circuitry 80 is a high gain optical amplifier circuit. The current signal $V_{70}$ developed in the photodiode 70 from the illumination of the lamp 50 is amplified and converted to a voltage signal $V_{80}$ by the sensor amplifier 80. The sensor amplifier 80 includes an operational amplifier 82 that has its power connections connected to power supply voltages $V_{ss}$ and $-V_{ss}$. The cathode of the photodiode 70 is connected to the inverting input of the operational amplifier 82, and the anode of the photodiode 70 is connected to the noninverting input of the operational amplifier 82. A capacitor 84 is connected between the output of the operational amplifier 82 and the inverting input of the operational amplifier 82. A resistor 86 is connected in parallel with the capacitor 84. A capacitor 85 and a resistor 83 are connected in series with each other, and in parallel with the capacitor 84. The noninverting input of the operational amplifier 82 is connected to ground. A capacitor 88 is connected between the power supply voltage $V_{ss}$ and ground. A capacitor 89 is connected between the power supply voltage $V_{ss}$ and ground. The output of the operational amplifier 82 is a feedback signal voltage $V_{80}$.

The error amplifier and loop compensation circuitry 90 receives the feedback signal voltage $V_{80}$ and a luminance level command voltage $V_{ARC}$. The luminance level command voltage $V_{ARC}$ is a constant DC signal preferably between 0 and 10 V, and is an input to the driver 10 that the user of the driver 10 selects to attain a corresponding, desired level of illumination from the fluorescent lamp 50. The amount of light generated by the fluorescent lamp 50 is proportional to the selected luminance level command voltage $V_{ARC}$. The error amplifier and loop compensation circuitry 90, as its name implies, compensates for and controls the gain of the optical feedback loop.

Error amplifier and loop compensation circuitry 90 includes an operational amplifier 104. The negative input of the operational amplifier 104 is coupled by a resistor 118 and a resistor 92 in series, to the output signal $V_{80}$ of sensor amplifier circuitry 80. A capacitor 96 is coupled between the junction of the resistors 92 and 118 and ground. A capacitor 108 and a resistor 106 are serially connected between the inverting input of the operational amplifier 104 and the output of the operational amplifier 104. Power connections of the operational amplifier 104 are connected to power supply voltages $V_{ss}$ and $-V_{ss}$. A capacitor 110 is connected between the power supply voltage $V_{ss}$ and ground. A capacitor 112 is connected between the power supply voltage $-V_{ss}$ and ground. The noninverting input of the operational amplifier 104 is connected to ground through a capacitor 116. A resistor 114 is connected between the power supply voltage $-V_{ss}$ and the noninverting input of the operational amplifier 104.

The error amplifier and loop compensation circuitry 90 produces an output in the form of an error signal voltage $V_{90}$ that is proportional to the arc command voltage $V_{ARC}$ and to the signal $V_{80}$ of the optical amplifier 80, approximately according to the following equation:

$$V_{90}=V_{ARC}+[V_{ARC}-\beta V_{80}] \quad (1)$$

where and β are related to the circuit elements of the error amplifier and loop compensation circuitry 90, such as the resistor 106, the capacitor 108, the resistor 118, the capacitor 96 and resistor 92. The output voltage $V_{90}$ of the operational amplifier 104 is connected to the inverting input of a comparator 152 of the comparator circuit 1 50.

As indicated by equation 1 above, the output $V_{90}$ of the error amplifier and loop compensation circuitry 90 increases as the $\beta V_{80}$ term decreases, and decreases as the $\beta V_{80}$ term increases. As will be described in more detail below, this equation controls the driver 10 according to the general principal that when the output voltage $V_{90}$ is above a threshold value, the driver 10 is allowed to continue producing waveforms to drive the lamp 50, while when the output voltage $V_{90}$ is below the threshold value, the driver 10 is generally prevented from producing further voltage waveforms, thus in essence shutting off the driver 10. As will be described in more detail below, this effect can be seen for the waveforms $V_{90}$ and $V_{30a}$ in the short-term in FIG. 5A and 5B, and in the long-term in FIGS. 6A and 6B. Thus, when the $\beta V_{80}$ term decreases below a certain value (thus generally indicating that the illumination level of the lamp 50 is lower than the desired illumination level), the output voltage $V_{90}$ is above the threshold value, thus allowing the driver 10 to continue driving the lamp 50. In contrast, when the $\beta V_{80}$ term increases above a certain level (thus indicating that the illumination from the lamp 50 is greater than the desired level of illumination), the output voltage $V_{90}$ becomes lower than the threshold, and effectively shuts down the driver 10 so as to cause the illumination from the lamp 50 to decrease.

As described above, the output $V_{90}$ from equation 1 is compared by comparator 150 to an output $V_{130}$ from current sense amplifier circuitry 130. The current sense amplifier circuitry 130 forms part of a current feedback closed control loop. The current sense amplifier circuitry 130 detects the current flowing through the inductor 38, the transformer 44, and the n-channel FETs 62 and 64 of power delivery and wave-shaping circuitry 30 by measuring the voltage $V_{30}$ developed across the current sense resistor 72. The junction between the sense resistor 72 and the sources of the n-channel FETs 62 and 64 produces the signal $V_{30c}$ that is connected to the current sense amplifier circuitry 130 which outputs a voltage signal $V_{130}$ that is provided to the comparator circuit 150.

Current sense amplifier circuitry 130 includes an operational amplifier 138. The noninverting input of the operational amplifier 138 is connected to ground through a capacitor 136. The noninverting input of the operational amplifier 138 is also connected to one terminal of a resistor 134. The other terminal of the resistor 134 is connected to ground through a capacitor 132. The junction between the resistor 134 and the capacitor 132 is connected to one terminal of a resistor 131. The other terminal of the resistor 131 is connected to the drains of the n-channel FETs 62 and 64. The two resistors 131 and 134, and the two capacitors 132 and 136 form a double-pole low-pass filter that helps remove high-frequency spikes. The inverting input of the operational amplifier 138 is connected to ground through a resistor 146. The inverting input of the operational amplifier 138 is also connected to the output of the operational amplifier 138 through a resistor 144. The output of the operational amplifier 138 is connected to the anode of a diode 145. The cathode of the diode 145 is connected to the inverting input of the operational amplifier 138 through a resistor 147. Power connections of the operational amplifier 138 are connected to power supply voltages $V_{ss}$ and $-V_{ss}$. A capacitor 142 is connected between the power supply voltage $V_{ss}$ and ground. A capacitor 140 is connected between the power supply voltage $-V_{ss}$ and ground. The output of the operational amplifier 138 is a current signal voltage $V_{130}$ that is applied to the comparator circuit 150 through a resistor 151.

The comparator circuit 150 compares the current signal voltage $V_{130}$ produced by the current sense amplifier circuitry 130 to the error signal voltage $V_{90}$ produced by the error amplifier and loop compensation circuitry 90. The comparator circuit 150 includes a comparator 152. The error signal voltage $V_{90}$ is applied to the inverting input of the comparator 152. The current signal voltage $V_{130}$ is applied to the noninverting input of the comparator 152 through the resistor 151. Power supply connections of the comparator 152 are connected to power supply voltages $V_{ss}$ and $-V_{ss}$. A capacitor 156 is connected between the power supply voltage $V_{ss}$ and ground. A capacitor 153 is connected between the power supply voltage$-V_{ss}$ and ground.

The noninverting input of the comparator 152 is connected to the output of the comparator 152 through a resistor 154 and a resistor 155, in series. A resistor 158 is connected between 5 V DC and the junction of resistor 154 and resistor 155. The junction between the resistor 154 and the resistor 155 is also connected to the cathode of a diode 159. The anode of the diode 159 is connected to ground. The junction between the resistor 154 and the resistor 155 is also applied to a series of Schmitt triggers 162 and 164. The Schmitt triggers 162 and 164 have hysteresis to reject any noise in the output of the comparator circuit 150. The Schmitt triggers 162 and 164 allow transitions in the output of the comparator circuit 150 to be fast and sharp to optimally toggle the flip-flop 52 of power control circuitry 15. The output of the comparator 152 is applied to the input of the Schmitt trigger 162 through resistor 155. The output of the Schmitt trigger 162 is applied to the input of the Schmitt trigger 164. The output of the Schmitt trigger 164 is the voltage signal $V_{150}$. As described above, the voltage signal $V_{150}$ is an input to power control circuitry 15, and is connected to the input C of the flip-flop 52 and to the input of the FET diver amplifier 16.

When the current signal voltage $V_{130}$ is greater than the error signal voltage $V_{90}$, the comparator circuit 150 outputs 5 V on the voltage signal $V_{150}$. When the current signal voltage is less than the error signal, the comparator circuit 150 outputs 0 V on the voltage signal $V_{150}$. The comparator circuit 150 controls the p-channel FET amplifier 16 that switches the p-channel FET 32 to maintain the current in the inductor 38 at a constant DC level, preferably between 0 to 5 A DC . A small saw-tooth ripple appears on the inductor current due to hysteresis produced by the comparator circuit 150.

Specific values for the components of FIG. 3 are shown in the following table:

TABLE 1

| Ref. Designator | Part Value | Ref. Designator | Part Value |
|---|---|---|---|
| 16 | MIC4420 | 153 | .1 uF |
| 18 | .1 uF | 156 | .1 uF |
| 22 | 1 uF | 158 | 1 Kohm |
| 24 | LL4148 | 154 | 49.9 Kohm |
| 26 | 100 Kohm | 151 | 8.75 Kohm |
| 32 | IRFP9140 | 140 | .1 uF |
| 34 | 28 uF | 142 | .1 uF |
| 36 | 100 ohm | 131 | 1 Kohm |
| 38 | 150 uH | 134 | 1 Kohm |
| 40 | MBR 10100 | 132 | 1000 pf |
| 33 | 174 uH | 136 | 1000 pf |
| 35 | .1 uF | 72 | .1 ohm |
| 44 | 6-6P/120-120S | 110 | .1 uF |
| 68 | 150 pf | 112 | .1 uF |
| 70 | OSD-15E | 144 | 10 Kohm |
| 50 | FFL-990-HE | 145 | 1N4153 |
| 54 | MIC4420 | 146 | 1 Kohm |
| 56 | MIC4420 | 147 | 20 Kohm |
| 58 | .1 uF | 106 | 10 Kohm |
| 60 | .1 uF | 108 | 100 pf |
| 63 | 20 ohm | 114 | 402 Kohm |
| 61 | 20 ohm | 116 | .1 uF |
| 62 | IRFP450 | 98 | 1 Kohm |
| 64 | IRFP450 | 118 | 49.9 Kohm |
| 52 | 74HCT74 | 96 | .1 uF |
| 164 | 74HC14 | 92 | 1 Kohm |
| 162 | 74HC14 | 88 | .1 uF |
| 82 | AD645 | 89 | .1 uF |
| 104 | OP37A | 84 | 180 pf |
| 138 | OP37A | 83 | 10 Kohm |
| 152 | LM139A | 85 | 1 uF |
| 159 | LL4148 | 86 | 4 Kohm |
| 155 | 3 Kohm | 72 | Shielded 2-conductor cable |

Figure 4:
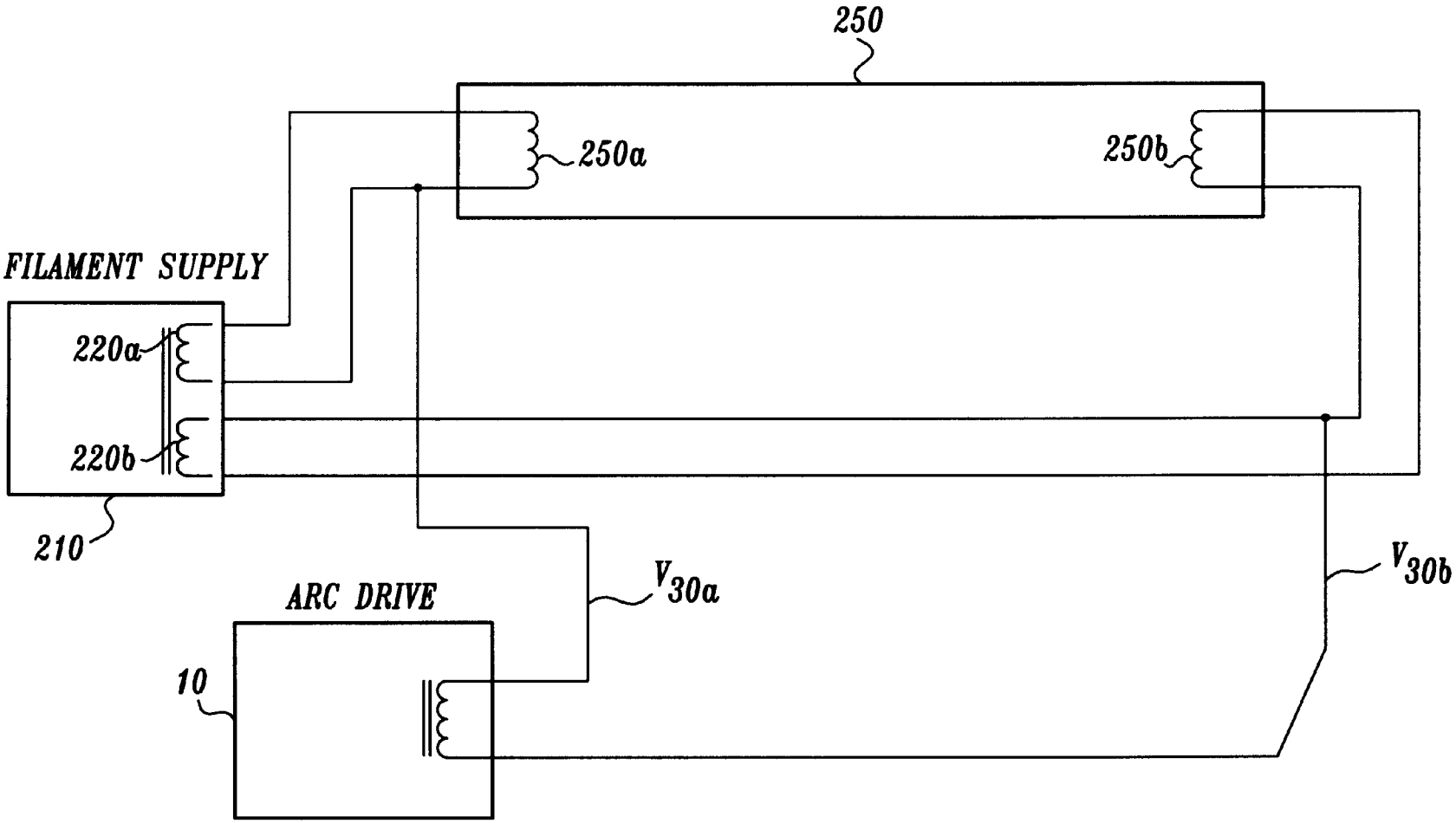
FIG. 4 is a schematic diagram of a circuit for using the driver of FIG. 2 to drive a hot-cathode lamp.

As illustrated in FIG. 4, the driver 10 of the present invention, while previously being described with respect to a cold cathode lamp 50, may also be operated with a hot cathode lamp. As shown in FIG. 4, a hot cathode lamp 250 has two filaments 250*a* and 250*b*. Filament 250*a* receives a driving voltage as signal $V_{30a}$ from driver 10, and filament 250*b* receives a driving voltage as signal $V_{30b}$ from driver 10. The filaments 250*a* and 250*b* also receive current from a filament supply 210. Filament supply 210 includes a transformer with two secondary windings 220*a* and 220*b*. Winding 220*a* is coupled to filament 250*a*, so that current generated in the secondary winding 220 is applied to the filament 250*a*. Secondary winding 220*b* is coupled to filament 250*b*, so that current applied through the winding 220*b* is applied to the filament 250*b*. In general, the circuit of FIG. 4 shows that the driver 10 may be operated with either a hot or cold cathode lamp.

The operation of the driver 10 at low levels of illumination will now be discussed in connection with FIGS. 5A–5B and 6A–6B. FIGS. 5A–5B and 6A–6B are graphs illustrating the drive voltage produced by the driver 10 and the response of the fluorescent lamp 50 at low levels of illumination. The x-axis represents time, each complete division in FIGS. 5A and 5B representing 100 microseconds, and in FIGS. 6A and 6B representing 5 milliseconds. FIGS. 6A and 6B are thus showing an overall much larger time period. The y-axis represents voltage. For FIGS. 5A and 6A, each division of the y-axis represents 200 V, and for FIGS. 5B and 6B each division represents 500 millivolts. FIGS. 5A and 6A are graphs illustrating the voltage $V_{30a}$ applied at the electrode of the fluorescent lamp 50. FIGS. 5B and 6B are graphs showing the output signals $V_{90}$ and $V_{130}$ from the error amplifier and loop compensation circuitry 90 and the current sense amplifier circuitry 130, respectively.

In operation, before the time t1, assume that the illumination from the fluorescent lamp 50 is falling. Falling illumination from the fluorescent lamp 50 causes a corresponding decrease in the output from the optical sensor 70 and a corresponding decrease in the feedback signal voltage $V_{80}$. The error amplifier and loop compensation circuitry 90 compares the feedback signal voltage $V_{80}$ with the arc command voltage $V_{ARC}$ to produce the error signal voltage $V_{90}$, according to the equation provided above. Thus, as feedback signal voltage $V_{80}$ decreases, output signal $V_{90}$ increases, as can be seen during the period of FIG. 6B preceding time t1. The comparator circuit 150 compares the error signal voltage $V_{90}$ with the current signal voltage $V_{130}$. In this event, before time t1, the error signal voltage $V_{90}$ is less than the current signal voltage $V_{130}$. As a result, the output of the comparator circuit 150 is high, i.e., 5 V. The 5 V signal is applied to the p-channel FET drive 14 through the Schmitt triggers 162 and 164, biasing the gate of the p-channel FET 32 of the current drive 30 to turn off the p-channel FET 32. The input C of the flip-flop 52 also receives the 5 V signal. Assume that the output Q is high, i.e., 5 V, and thus the output not Q is low, i.e., 0 V. Based on the Q output and the not Q output, the amplifiers 54, 56 bias the gates of the n-channel FETs 62, 64, respectively, so that the n-channel FET 62 is turned on while the n-channel FET 64 is turned off. As a result, no voltage is applied to the lamp 50 at this time. The absence of voltage applied to the fluorescent lamp 50 is represented by portion 320 of signal $V_{30a}$ in FIGS. 5A and 6A. Because no voltage is applied, the fluorescent lamp 50 outputs no illumination capable of being detected by the photodiode 70, and the illumination that was produced during a previous period continues to decrease. Illumination in the lamp may decrease slowly because of the many complex reactions that occur within a fluorescent lamp, as described previously with respect to FIG. 1.

Just after the time t1, because no voltage is applied to power the fluorescent lamp 50, the illumination of the fluorescent lamp 50, as well as the feedback signal voltage $V_{80}$, decreases. As the illumination decreases, the error signal voltage $V_{90}$ increases. The error signal voltage $V_{90}$ increases until it exceeds the current signal voltage $V_{130}$ (as best seen during the time leading up to time t1 in FIG. 6B), causing the output of the comparator circuit 150 to change to 0 V, which in turn causes the p-channel FET 32 to turn on. Turning on the p-channel FET 32 increases current flow through the inductor 38, the n-channel FET 62, and the sense resistor 72. This current produces a voltage to drive the fluorescent lamp 50. The voltage is represented by portion 322 of voltage signal $V_{30a}$ of FIG. 5A. This first swing of voltage applied to the fluorescent lamp 50 is the first step for producing traveling waves, which produce the low levels of illumination in the fluorescent lamp 50.

Turning on the p-channel FET 32 increases the current through the sense resistor 72 and thus increases the current signal voltage $V_{130}$ produced by the current sense amplifier circuitry 130. When the current signal voltage $V_{130}$ exceeds the error signal voltage, the output of the comparator circuit 150 becomes 5 V, creating a positive going edge applied to the input C of the flip-flop 52. The positive going edge causes the flip-flop 52 to flip the values of the Q output and the not Q output. As a result, the gates of the n-channel FETs 62, 64 are biased so that the n-channel FET 64 is turned on while the n-channel FET 62 is turned off Turning on the n-channel FET 64 causes the current to flow through the n-channel FET 64 and not the n-channel FET 62, reversing the polarity of the voltage applied to the fluorescent lamp 50. The reversal of polarity is represented by portion 324 of voltage signal $V_{30a}$ in FIG. 5A.

Because the output of the comparator circuit 150 is 5 V, the p-channel FET 32 is turned off, and the flow of current through the inductor 38 and the transformer 44, and thus the application of voltage to the fluorescent lamp 50, decreases. As a result, the current signal voltage $V_{130}$ will decrease, as can be seen in FIG. 5B, until it is less than the error signal voltage $V_{90}$, causing the output of the comparator circuit 150 to be 0 V, and in turn causing the p-channel FET 32 to turn on. When the p-channel FET 32 is turned on, the current signal voltage $V_{130}$ will increase until it exceeds the error signal voltage $V_{90}$. This causes the output of the comparator circuit 150 to be 5 V, creating a positive going edge to toggle the flip-flop 52 and reverse the polarity of the voltage applied to the fluorescent lamp 50. The reversal in the polarity of applied voltage is represented by portion 326 of voltage signal $V_{30a}$ in FIG. 5A. Through this process, the driver 10 is self-resonating. In addition, it is notable that the energy absorption rate of the lamp 50 determines the time between oscillations and thus the frequency of operation. This phenomenon becomes especially important for high illumination levels which require a higher frequency of operation, as will be described below.

The operation of the driver 10 during low levels of illumination repeats the aforementioned process, increasing the illumination output of the fluorescent lamp 50, as shown by the slowly decreasing value of signal $V_{90}$ in FIG. 5B. It can be observed from the operation of the lamp 50 during the aforementioned process that an arc discharge is not being produced in the lamp. Thus, with reference to FIG. 1, it is apparent that the lamp is most likely being operated in the glow discharge region. As will be described in more detail below, the theory is that the oscillations of voltage signals $V_{30a}$ and $V_{30b}$, as shown in FIG. 5A, are producing a set of traveling waves that produce the glow discharge illumination. The illumination increases until the feedback signal voltage $V_{80}$ exceeds the arc command voltage $V_{ARC}$, indicating that the output level of the fluorescent lamp 50 exceeds the desired level. As a result, the error signal voltage $V_{90}$ will drop below the threshold which current signal $V_{130}$ can oscillate below. When the error signal voltage $V_{90}$ is less than the current signal $V_{130}$, the p-channel FET 32 will be turned off. Accordingly, at the time t2, power to the fluorescent lamp 50 is eliminated. The elimination of power is represented by portion 328 of voltage signal $V_{30a}$ in FIG. 5A. The illumination level of the fluorescent lamp 50 gradually falls from a peak value as indicated by the slow rise of signal $V_{90}$ in FIG. 6B. The driver 10 will not provide more driving oscillations to the fluorescent lamp 50 until the light detected by the photodiode 70 is equal to or less than the desired level, i.e., when the feedback signal voltage $V_{80}$ approaches the arc command voltage $V_{ARC}$, thus causing the error signal voltage $V_{90}$ to again exceed the current signal voltage $V_{130}$, as shown at time t3 in FIG. 6B. During low levels of illumination operation, the spacing between the sets of waveforms is increased or decreased by adjusting the luminance level command $V_{ARC}$ down or up. Thus, the level of illumination perceived by the human eye, which is an average of the varying levels of illumination indicated by signal $V_{90}$ in FIG. 6B, can be decreased or increased.

One theory of operation is that the oscillations of signal $V_{30a}$ in FIG. 5A produce two sets of traveling waves of voltage produced by waveforms $V_{30a}$ and $V_{30b}$ that are 180° out of phase with one another. Each traveling wave includes pulses formed by oscillations that resonate at a frequency that is lower than the frequency at which the driver 10 operates during high level operation, as described below. Each traveling wave originates from one of the electrodes of the fluorescent lamp 50 and progresses toward the center of the fluorescent lamp 50. A gas, such as mercury, is ionized by the wave as it travels through the fluorescent lamp 50. An increasing intensity of fluorescence is produced behind the traveling waves, causing the fluorescent lamp 50 to fill with plasma from the ends of the fluorescent lamp 50 first, and then the center of the fluorescent lamp 50.

The traveling wave theory in part comes from experimental results produced by placing sensors at various positions along the length of a serpentine lamp. It has been shown that optical sensors first detect optical outputs being produced closer to the ends of the lamp, before they are detected at the center. Thus, in theory, the optical output produced by the traveling waves is able to be measured at various positions as it propagates down the tube, with the optical output or ionization level first appearing near the ends of the tube before it appears in the center.

One technical journal article entitled "The Starting Process in Long Discharge Tubes," *J. Phys. D: Appl. Phys.* 21 (1988) 1130-36, by R. E. Horstman et al., discusses the starting process of an electrical discharge in a gas. With respect to long fluorescent tubes, the articles states:

In long discharge tubes the situation is more complicated. The electrodes are relatively far apart and wall effects are of the utmost importance, since the wall is in intimate contact with the discharge. It was observed by Thomson (1893) and later by Beams (1930) that the discharge starts with an intense luminosity having the shape of a solid cylinder with a conical tip moving from the high-voltage end towards the grounded end of the tube. Later, Snoddy et al. (1937) showed that this luminosity is accompanied by a potential wave. The speed of this wave was determined by means of an oscilloscope which measured the voltage induced in metal rings fixed around the tube as a function of time.

The article goes on to discuss, with respect to FIG. 3 of the article, that the wave front velocity is generally a function of the electrode potential.

Experimental results from the present inventive driver 10 support the concept that the speed of the traveling waves is proportional to the voltage potential on the electrodes of the fluorescent lamp 50. This is concluded from the fact that when a higher voltage is used to operate the driver 10, fewer oscillations are required before the illumination is detected at the center of the fluorescent lamp 50. In theory, this occurs because the faster traveling waves are able to reach the center of the fluorescent lamp 50 faster, thus requiring fewer oscillations of the driver 10 to achieve the illumination at the center of the lamp 50.

Thus, the lamp acts as a waveguide for the two sets of traveling wave fronts as they progress down the tube until they meet at the midpoint between the two electrodes. The theory as to why the cathode filaments are not damaged by the operation in the glow discharge region shown in FIG. 1 is as follows. Apparently, by using the traveling wave concept, most of the acceleration of the ions is perpendicular to the walls of the tube. This is because, by producing the traveling waves in the manner described above, most of the potential exists between the center of the tube and the walls of the tube. This phenomenon is sufficient to allow the potential to be directed toward the walls of the tube so that the lamp 50 can be operated. However, this phenomenon can be further assisted by the standard ground plane that is used with many fluorescent lamps. The standard ground plane is often placed behind the fluorescent tube, and is usually covered with a reflective coating so as to help reflect the illumination of the lamp. This metal plane is grounded, thus assisting to direct the acceleration of the ions from the high potential at the center of the tube as caused by the traveling waves, toward the edges of the tube, thus helping to prevent the filaments of the cathode from being damaged. The operation of the lamp in the glow discharge mode, by which acceleration of the ions is directed towards the walls of the tube, preserves the cathode filaments, and increases the life of the lamp. In addition, the smooth transition between the glow discharge region of operation and the arc discharge region of operation, as will be described below, also helps preserve the filaments and extend the lamp's life.

The present invention also helps preserve the filaments because, unlike the prior art methods, multiple transitions through the highest potential regions are not required. Prior art pulse width modulation methods require multiple transitions through the highest potential region because the current in fluorescent lamps does not change instantaneously. Thus, even though prior art lamps have typically driven lamps in the arc discharge mode where relatively lower voltage potentials exist, in order to get to the arc discharge level, the prior art lamps still had to go through a brief high voltage potential. In other words, as illustrated by the graph of FIG. 1, in order to drive a lamp to the arc discharge mode, a transition from the lowest current levels up to the arc discharge levels has to be made. Thus, the region from the $10^{-1}$ to the $10^{+1}$ current levels where up to 1400 V potential occurs still must be transitioned through, even though the prior art methods make a point of not operating in this region for very long. Even so, the multiple transitions through this region using the prior art pulse width modulation methods still exposes the lamp repeatedly to the brief high voltage potentials, which are damaging to the cathode filaments. This effect is avoided by the present invention which for low levels of illumination operates in the glow discharge region which does not require a transition through the highest potential region, and which for the high levels of illumination operates in a continuous arc mode which avoids the multiple transitions through the highest potential region.

Experimentation has indicated that the optical feedback loop from sensor 70 ensures that the proper number of oscillations in the waveforms $V_{30a}$ and $V_{30b}$ occur. This is important because a precise number of oscillations must be produced to achieve the desired level of illumination. Due to the sensitive nature of fluorescent lamps, as discussed above with reference to FIG. 1, if too few oscillations are produced, only part or none of the tube may be lit, and if too many oscillations are produced, then the lamp may jump into arc mode, or other flickering resulting. The number of needed oscillations is dependent in part on the present impedance of the lamp 50 which, as discussed with reference to FIG. 1, can be changing due to a multitude of factors. Thus, a given number of oscillations of the waveform $V_{30a}$ may produce one illumination effect at one time, and a different illumination effect at a different time. Thus, the optical feedback loop from sensor 70 is required to produce the precise number of oscillations that are needed.

With reference to the graph of FIG. 1, using the precise number of oscillations allows the system of the present invention to carefully ramp the current up to the desired glow discharge level, at which point the carefully controlled current may be halted before the arc discharge level is reached. As described previously, the nature of gas discharge lamps is such that without the careful control, it would be very easy to overshoot and drive the current to the arc discharge level, or undershoot and not illuminate the lamp properly. Thus, part of the circuit's control scheme is the nature with which the current is controlled so that it can be stopped precisely, and part of it is the actual stopping of the current at precisely the right time. The described circuit of the present invention and the waveforms it produces shown in FIGS. 5 and 6 accomplish both of these objectives by both precisely controlling the current and by using a feedback circuit that is able to provide the desired control for stopping the current.

The levels of current produced in the lamp 50 by the driver 10 will directly affect the levels of illumination as illustrated by FIG. 1. For the driver 10, it is assumed that a set of oscillations on the voltage signal $V_{30a}$, such as that shown in FIG. 5A, will produce a relatively set amount of current on the graph of FIG. 1, and a corresponding amount of illumination. FIG. 6A illustrates how, after a certain amount of time, another set of oscillations is produced. The time between sets of oscillations shown for signal $V_{30a}$ in FIG. 6A is determined by the level of illumination commanded by the signal $V_{ARC}$. In other words, while the level of illumination of the lamp 50 is changing as indicated by signal $V_{90}$ in FIG. 6B, the human eye averages the level of illumination at this frequency to result in a perceived average level of illumination. When the signal $V_{ARC}$ is increased, the number of oscillations in a set of oscillations such as those shown in FIG. 5A remains approximately the same, but the sets of oscillations such as those shown in FIG. 6A move relatively closer together as they occur more frequently. Thus, the average level of illumination, as could be seen with reference to voltage signal $V_{90}$ in FIG. 6B, increases, thus increasing the perceived level of illumination by the human eye. As will be described in more detail below, the smooth transition between low and high levels of illumination occurs as the sets of oscillations, such as those shown in FIG. 5A, are moved so close together that they become virtually continuous, as will be described below.

Once the sets of oscillations such as those shown in FIG. 5A have been moved so close together that they become virtually continuous, further increases in the command signal $V_{ARC}$ result in the circuit transitioning so that a higher frequency of operation is produced. In essence, when driving the fluorescent lamp 50 in this manner, the impedance of the tube is changed, so that the frequency of oscillation of the driver 10 increases. This process results in an increase in current through the lamp. At some point during the current increase, it has been experimentally observed that the driver transitions from the glow discharge mode of operation to the arc discharge mode of operation, as will be described in more detail below. In some experiments, the frequency of oscillation of the driver 10 has increased during the arc discharge mode to approximately twice the frequency that results during the glow discharge mode of operation. As described previously, the circuit is able to transition smoothly between the lower frequency glow discharge mode of operation and the higher frequency arc discharge mode of operation because the impedance of the tube itself is used as an integral part of the oscillation loop of the circuit. As described above, the impedance of the tube is one of the components that determines the frequency of operation of the driver 10. Thus, a single driver circuit is able to be used for both modes of operation, even though higher frequency oscillations are needed to produce the required higher currents for the arc discharge mode in the graph of FIG. 1.

Figures 7A, 7B:
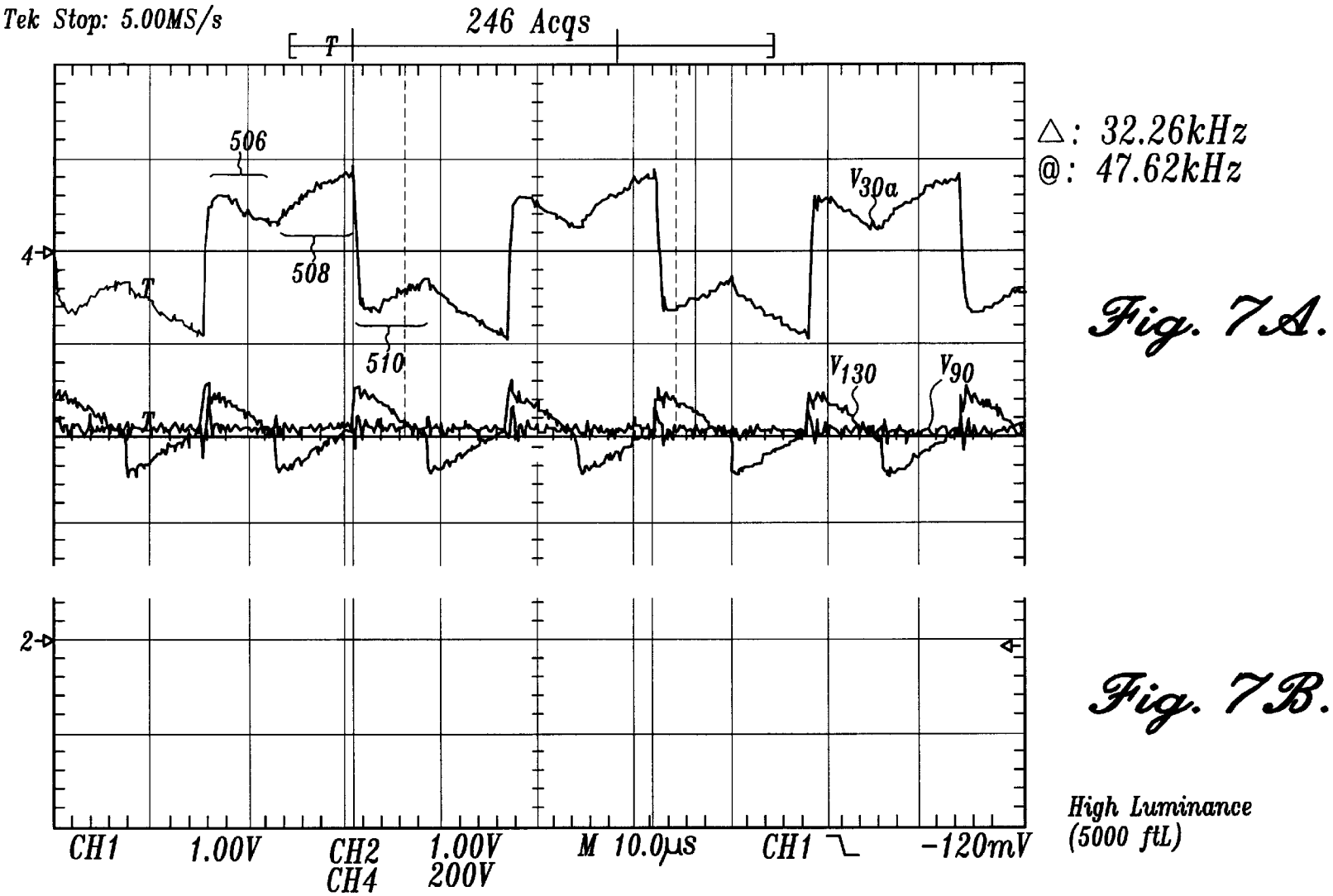
FIGS. 7A–7B are graphs illustrating the operation of the driver during high levels of illumination.

FIGS. 7A to 7B illustrate the operation of the driver 10 during the arc discharge mode. To drive the fluorescent lamp 50 at the high arc discharge levels of illumination, as described previously, the driver 10 does not produce traveling waves to power the fluorescent lamp 50. Rather, the transformer 44 powers the fluorescent lamp 50 with continuous resonant square waves of arc current and arc voltage across the electrodes of the fluorescent lamp 50. FIG. 7A shows the arc voltage on voltage signal $V_{30a}$. FIG. 7B shows the voltage signal $V_{130}$ and the voltage signal $V_{90}$. The x-axis represents time, each complete division representing 20 microseconds. The y-axis represents voltage, each complete division for signal $V_{30a}$ representing 200 V, each division for signals $V_{90}$ and $V_{130}$ representing 1 V.

During high levels of illumination, the current flowing through the inductor 38 is at an approximately constant DC level. Also, the light output from the lamp 50 is at a constant level and the signal $V_{90}$ from the error amplifier 90 is at a DC level. Assume that, during the outset of high level operation, the p-channel FET 32 is turned from on to off by the output of the comparator circuit 150 becoming 5 V. The p-channel FET 32 turns off because the error signal voltage $V_{90}$ is less than the current signal voltage $V_{130}$. Turning off the p-channel FET 32 decreases the flow of current through the inductor 38, and thus decreases the application of arc voltage by the transformer 44. The decrease in arc voltage is represented by portion 506 of voltage signal $V_{30a}$. The decrease in arc voltage in turn causes a decrease in the current flowing through the inductor 38 and the sense resistor 72. When the current signal voltage $V_{130}$ becomes less than the error signal voltage $V_{90}$, the output of the comparator circuit 150 becomes 0 V, turning on the p-channel FET 32. Turning on the p-channel FET 32 increases current flow in the inductor 38 and, in this example, the n-channel FET 62. Alternatively, the current could flow through the n-channel FET 64, depending on the flow of current before the p-channel FET 32 is turned on. The increase in current causes an increase in arc voltage, which is represented by portion 508 of voltage signal $V_{30a}$. The increased current in the inductor 38 causes the current signal voltage $V_{130}$ to also increase relative to the error signal voltage $V_{90}$. When the current signal voltage $V_{130}$ becomes greater than the error signal voltage $V_{90}$, the output of the comparator circuit is 5 V. The positive going edge created by the output of the comparator circuit 150 and applied to the flip-flop 52 causes the current flowing through the inductor 38 and the sense resistor 72 to flow through the n-channel FET 64 instead of the n-channel FET 62. As a result, the polarity of the arc voltage is reversed and the arc voltage decreases (which appears on the voltage signal $V_{30a}$ as trending upward toward the zero level since the polarity has been reversed) because the p-channel FET 32 is turned off, as shown by portion 510 of voltage signal $V_{30a}$.

The production of the arc voltage illustrated by voltage signal $V_{30a}$ in FIG. 7A continues in the manner just described. The arc voltage decreases until the current signal voltage $V_{130}$ is less than the error signal voltage $V_{90}$. Then the output of the comparator circuit 150 becomes 0 V, turning on the p-channel FET 32. The arc voltage increases as current flows through the inductor 38. When the error signal voltage $V_{90}$ becomes less than the current signal voltage $V_{130}$, the output of the comparator circuit 150 becomes 5 V. The positive going edge applied to the flip-flop 52 reverses the polarity of the arc voltage. The arc current applied to the fluorescent lamp 50 closely resembles and is in phase with the arc voltage.

While the preferred embodiment of the invention has been illustrated and described, it will be appreciated that various changes can be made therein without departing from the spirit and scope of the invention. For example, it will be appreciated that the function of the comparator circuit 150, as well as other components of the driver 10, can be alternatively implemented. The present invention has been described in relation to a preferred embodiment and several variations. One of ordinary skill after reading the foregoing specification will be able to effect various other changes, alterations, and substitutions of equivalents without departing from the broad concepts disclosed. It is therefore intended that the scope of a Letters Patent granted hereon be limited only by the definition contained in the appended claims and equivalents thereof, and not by limitations of the embodiments described thereof The embodiments of the invention in which an exclusive property or privilege is claimed are defined as follows:

1. A method of driving a gas discharge lamp, the method comprising the steps of;

(a) producing low levels of illumination in the lamp by generating a voltage waveform and applying the voltage waveform to the lamp so as to produce a set of traveling waves in the lamp, the set of traveling waves producing a current in the lamp that is lower than the current that is required for an arc discharge in the lamp without requiring the use of a set of electrodes that are external to the lamp;

(b) stopping production of the set of traveling waves when an output or ionization level of the lamp has reached a selected level; and (c) repeating steps (a) and (b) at selected intervals to produce a selected average level of illumination for the lamp.

2. The method of claim 1, wherein high levels of illumination in the lamp are produced by producing an arc discharge within the lamp.

3. The method of claim 2, wherein the transition between the production of low levels of illumination and high levels of illumination is continuous.

4. The method of claim 2, wherein the gas discharge lamp that is driven is a flat lamp and the overall dimming ratio of the highest level of illumination to the lowest level of illumination of the lamp when viewed directly is greater than 50,000:1 and when the lamp is viewed from behind an AM LCD the dimming ratio is greater than 100,000:1.

5. The method of claim 2, wherein the frequency of the voltage waveform that is generated and applied to the lamp is dependent on the impedance of the lamp, such that the transition from the low levels of illumination to the high levels of illumination is accompanied by a change in the frequency of the voltage waveform.

6. The method of claim 5, wherein the frequency of the voltage waveform that is generated and applied to the lamp is higher at the high levels of illumination of the lamp than at the low levels of illumination of the lamp.

7. The method of claim 1, wherein step (b) is implemented through the use of a sensor that senses an output or ionization level of the lamp and provides feedback of the output through a feedback loop which stops production of the set of traveling waves when the output has reached a selected level.

8. The method of claim 7, wherein the lamp comprises two terminals, and the sensor is located near the midpoint between the two terminals of the lamp.

9. The method of claim 7, wherein the length of the selected interval of step (c) between the repeating of steps (a) and (b) is determined according to the time it takes for the sensed illumination of the lamp to fall below a selected level.

10. The method of claim 1, wherein the voltage waveforms that are generated and applied to the lamp are approximately square waves.

11. The method of claim 1, wherein the lamp comprises two terminals and the voltage waveforms that are applied to one terminal of the lamp are approximately 180° out of phase with the voltage waveforms that are applied to the other terminal of the lamp.

12. A driver for driving a gas discharge lamp, the driver comprising:

(a) power delivery and wave-shaping circuitry for producing voltage waveforms and applying the voltage waveforms to the lamp;

(b) a feedback circuit controlling operation of the power delivery and wave-shaping circuitry and including an optical sensor in an optical feedback loop for sensing the optical output of the lamp; and (c) wherein to produce low levels of illumination, the power delivery and wave-shaping circuitry applies sets of voltage waveforms to the lamp, the sets of voltage waveforms at low levels of illumination producing a current in the lamp that is less than the current required for an arc discharge in the lamp without requiring the use of a set of electrodes that are external to the lamp, the start of a set of voltage waveforms occurring when the sensor detects that the optical output of the lamp is below a first threshold, and the end of the set of voltage waveforms occurring when the sensor detects that the optical output of the lamp is above a second threshold.

13. The circuit of claim 12, wherein the first and second thresholds are at approximately the same level.

14. The circuit of claim 12, wherein to produce high levels of illumination the power delivery and wave-shaping circuitry provides a voltage waveform to the lamp that is continuous and that produces a current in the lamp sufficient for causing an arc discharge in the lamp.

15. The circuit of claim 14, wherein the transition between the production of high and low levels of illumination is continuous.

16. The driver of claim 15, wherein the dimming ratio between the highest and lowest levels of illumination that can be produced is greater than 20,000:1.

17. A driver for driving a gas discharge lamp, the driver comprising:

(a) power delivery and wave-shaping circuitry coupled to the lamp for providing voltage waveforms to the lamp;

(b) an optical feedback loop for providing an output representing the optical output of the lamp, the output of the optical feedback loop being used to control the power delivery and wave-shaping circuitry; and (c) a current feedback loop for providing an output representing the power delivered to the lamp, the current feedback loop being used to control the frequency of the voltage waveforms that are provided by the power delivery and wave-shaping circuitry.

18. The driver of claim 17, wherein for low levels of illumination the power delivery and wave-shaping circuitry provides voltage waveforms to the lamp that produce a current within the lamp that is below the level of current that is required for an arc discharge in the lamp without requiring the use of a set of electrodes that are external to the lamp.

19. The circuit of claim 18, wherein the optical feedback loop includes a sensor and an error amplifier and loop compensation circuit, the sensor sensing the optical output of the lamp and providing a signal to the error amplifier and loop compensation circuit, the error amplifier and loop compensation circuit also receiving a luminance level command signal, the error amplifier and loop compensation circuit producing as an output a signal representing the differential between a factor of the luminance level command signal and a factor of the sensor output signal.

20. The driver of claim 19, further comprising a comparator and a power control circuit, the comparator receiving as a first input the output of the error amplifier and loop compensation circuit and as a second input the output of the optical feedback loop, the comparator switching the states of its output signal each time the output of the error amplifier and loop compensation circuit crosses the output of the optical feedback loop.

21. The driver of claim 20, wherein the power delivery and wave-shaping circuit further comprises:

a transformer for providing power to the lamp, the transformer having a primary winding divided into first and second halves by a center tap;

a first switch for completing a circuit path between the first half of the primary winding and ground;

a second switch for completing a circuit path between the second half of the primary winding and ground;

a current sense resistor coupled in the circuit path of the first and second switches for producing a voltage indicative of the current through the primary winding through either the first or second halves; and a third switch for completing a circuit path between the center tap of the primary winding and a power supply.

22. The driver of claim 21, wherein the power control circuit further comprises:

a flip-flop having an input and an output Q and an output not Q, the input of the flip-flop being coupled to the output of the comparator, the output Q being coupled to the gate of the first switch of the power delivery and wave-shaping circuit, the output not Q being coupled to the gate of the second switch of the power delivery and wave-shaping circuit; and a switch driver coupled between the output of the comparator and the gate of the third switch of the power delivery and wave-shaping circuit.

23. A driver for driving a gas discharge lamp, the driver comprising:

a transformer coupled to the lamp for providing power to the lamp;

power delivery circuitry for providing power to the transformer;

an optical feedback loop with an output that is representative of an output of the lamp;

a power feedback loop with an output that is representative of the power provided to the lamp;

oscillation circuitry, the oscillation circuitry initially activating the power delivery circuitry to provide power to the transformer when the output of the optical feedback loop is below a selected level, the oscillation circuitry then becoming self-resonating as the swings of the output of the power feedback loop cause additional oscillations to occur, the oscillation circuitry ceasing the set of oscillations when the output of the optical feedback loop is above the selected level.

24. The driver of claim 23, wherein the oscillation circuitry comprises a comparator and power control circuitry.

25. The driver of claim 23, wherein the driver operates during a low illumination state such that the oscillations produce a current in the lamp that is below the current required for an arc discharge without requiring the use of a set of electrodes that are external to the lamp.

26. The driver of claim 25, wherein to alter the perceived illumination level of the lamp during a low illumination state, the oscillation circuitry produces similar sets of oscillations but alters the time between production of sets of oscillations.

27. A method of driving a gas discharge lamp to attain varying levels of illumination comprising:

producing low levels of illumination in the lamp by applying sets of voltage waveforms to the lamp, the sets of voltage waveforms producing a current in the lamp that is less than the current required for an arc discharge without requiring the use of a set of electrodes that are external to the lamp; and producing high levels of illumination in the lamp by applying an approximately continuous voltage waveform to the lamp, the approximately continuous voltage waveform producing a current in the lamp sufficient for an arc discharge.

28. The method of claim 27, wherein the sets of voltage waveforms produced during the low illumination state are square waves.

29. The method of claim 27, wherein the voltage waveform produced during the high illumination state is a square wave.

30. The method of claim 27, wherein the lamp has two ends with terminals, the terminals being electrodes in a cold cathode lamp and filaments in a hot cathode lamp, the voltage waveforms in both the low and high illumination states being applied to the terminals of the lamp.

31. The method of claim 27, wherein the sets of voltage waveforms applied during the low illumination state produce sets of traveling waves within the lamp, the traveling waves progressing through the lamp at a speed, the method further comprising increasing the speed of the traveling waves by increasing the voltage of the sets of voltage waveforms.

32. The method of claim 27, further comprising:

selecting a desired level of illumination from the gas discharge;

producing a luminance level command signal related to the desired level of illumination;

detecting an actual level of illumination from the gas discharge lamp and producing a feedback signal voltage related to the actual level of illumination; and comparing the feedback signal voltage with the luminance level command signal to produce an error signal voltage.

33. The method of claim 32, further comprising:

producing a current signal voltage related to the voltage waveforms applied to the lamp; and comparing the current signal voltage with the error signal voltage.

34. The method of claim 33, further comprising:

using the varying nature of the current signal voltage to produce further oscillations in the voltage waveforms that are applied to the lamp, thus making the system self-resonating.

35. The method of claim 27, wherein the transition between the low illumination states and the high illumination states is continuous.

36. A driver for attaining various levels of illumination from a gas discharge lamp, comprising:

a current drive for producing a current to generate a traveling wave of voltage and an arc voltage through the fluorescent lamp; and means, coupled to the current drive, for comparing a current signal voltage with an error signal voltage, the current signal voltage related to the current, the error signal related to an actual level of illumination and a desired level of illumination from the gas discharge lamp, the means for comparing producing an output signal controlling the current drive to increase the current when the error signal voltage is greater than the current signal voltage and decrease the current when the error signal voltage is less than the current signal voltage.

37. The driver of claim 36, wherein the means for comparing includes a comparator circuit.

38. The driver of claim 36, further comprising:

a photodiode for detecting the actual level of illumination from the gas discharge lamp;

an optical amplifier, coupled to the photodiode, for producing a feedback signal voltage related to the actual level of illumination; and an error amplifier and compensation, coupled between the optical amplifier and the means for comparing, for receiving the feedback signal voltage and a luminance level command signal, the luminance level command signal being related to the desired level of illumination, the error amplifier and compensation producing the error signal voltage based on the luminance level command signal and the feedback signal voltage.

39. The driver of claim 36, wherein the transition between the generation of traveling waves of voltage and an arc voltage is continuous.

40. The driver of claim 36, further comprising a current loop amplifier for measuring the current and producing the current signal voltage based on the current.

41. The driver of claim 36, further comprising a transformer coupled to the current drive, for receiving the current from the current drive to provide power to the lamp.

42. The driver of claim 41, further comprising a first drive circuit, coupled between the means for comparing and the current drive, to selectively control the current provided by the current drive based on the output signal of the means for comparing.

43. The driver of claim 42, further comprising:

a first switch, coupled between the transformer and the current loop amplifier; and a second switch, coupled between the transformer and the current loop amplifier, the first switch and the second switch alternatingly turning on and off to periodically reverse the direction of the current through the transformer so that an AC signal is provided to the fluorescent lamp.

44. The driver of claim 43, further comprising a second drive circuit, coupled between the means for comparing and the first switch and the second switch, the second drive circuit alternatingly turning on and off the first switch and the second switch based on the output signal of the means for comparing.

45. A driver for driving a gas discharge lamp to various levels of illumination, comprising:

a photodiode for detecting an actual level of illumination from the gas discharge lamp;

an optical amplifier, coupled to the photodiode, for producing a feedback signal voltage related to the actual level of illumination;

an error amplifier and loop compensation circuitry, coupled to the optical amplifier, for receiving the feedback signal voltage and a luminance level command signal, the luminance level command signal being related to a desired level of illumination, the error amplifier and loop compensation circuitry producing an error signal voltage based on the luminance level command signal and the feedback signal voltage;

a current drive for producing a current;

a transformer, coupled to the current drive, for receiving the current from the current drive to provide traveling square waves of voltage and a continuous arc voltage to the gas discharge lamp;

a current loop amplifier for receiving the current and producing a current signal voltage based on the current; means for comparing, coupled to the current loop amplifier and the error amplifier and loop compensation circuitry, the current signal voltage with the error signal voltage, and producing an output signal;

a first drive circuit, coupled between the means for comparing and the current drive, for receiving the output signal and selectively controlling the current provided by the current drive based on the output signal, the current drive increasing the current when the error signal voltage is greater than the current signal voltage and decreasing the current when the error signal voltage is less than the current signal voltage;

a first switch, coupled between the transformer and the current loop amplifier;

a second switch, coupled between the transformer and the current loop amplifier, the first switch and the second switch alternatingly turning on and off to periodically reverse the direction of the current through the transformer so that a varying voltage signal is provided to the gas discharge lamp; and a second drive circuit, coupled between the means for comparing and the first switch and the second switch, for controlling the first switch and the second switch to alternatingly turn on and off.

46. A method of driving a gas discharge lamp, the gas discharge lamp having a voltage-current characteristic curve with Townsend, glow, and arc discharge regions, the method not requiring the use of a set of external electrodes that are located along the length of the lamp, the method comprising the steps of:

(a) producing low levels of illumination in the lamp by generating a voltage and applying the voltage to the lamp, the voltage being generated so as to increase the current in the lamp at a controlled rate such that the increase in current can be stopped in the glow discharge region of the voltage-current characteristic of the lamp after the Townsend discharge region and before the arc discharge region;

(b) measuring an output of the lamp and comparing it to a selected output level and stopping the generation of the voltage across the lamp such that the increase in current in the lamp is stopped in the glow discharge region of the lamp when the measured output of the lamp reaches the selected output level; and (c) repeating steps (a) and (b) at intervals selected to produce a desired average level of low illumination in the lamp.

47. The method of claim 46, wherein the gas discharge lamp that is driven is a flat lamp.

* * * * *